US009938794B2

(12) United States Patent
Read et al.

(10) Patent No.: US 9,938,794 B2
(45) Date of Patent: Apr. 10, 2018

(54) GUIDED LOCKING RAM BLOCKS

(71) Applicant: BOP Technologies, LLC, The Woodlands, TX (US)

(72) Inventors: Herbert Jay Read, Huntsville, TX (US); Mark F. Alley, The Woodlands, TX (US)

( * ) Notice: Subject to any disclaimer, the term of this patent is extended or adjusted under 35 U.S.C. 154(b) by 0 days.

(21) Appl. No.: 15/629,522

(22) Filed: Jun. 21, 2017

(65) Prior Publication Data

US 2017/0362911 A1 Dec. 21, 2017

Related U.S. Application Data

(63) Continuation-in-part of application No. 15/413,109, filed on Jan. 23, 2017, now abandoned.

(60) Provisional application No. 62/352,916, filed on Jun. 21, 2016.

(51) Int. Cl.
*E21B 33/06* (2006.01)
*E21B 29/08* (2006.01)

(52) U.S. Cl.
CPC ..... *E21B 33/063* (2013.01); *E21B 29/08* (2013.01); *E21B 33/062* (2013.01)

(58) Field of Classification Search
CPC ..... E21B 33/063; E21B 33/062; E21B 29/04; E21B 29/08; E21B 29/00; F15B 3/00
See application file for complete search history.

(56) References Cited

U.S. PATENT DOCUMENTS

| | | | | |
|---|---|---|---|---|
| 4,081,027 A * | 3/1978 | Nguyen | E21B 29/08 116/55 |
| 4,132,265 A * | 1/1979 | Williams, Jr. | E21B 29/08 137/242 |
| 7,354,026 B2 * | 4/2008 | Urrutia | E21B 33/063 251/1.1 |
| 7,367,396 B2 * | 5/2008 | Springett | E21B 33/063 166/298 |
| 2013/0220627 A1 * | 8/2013 | Coppedge | E21B 33/038 166/345 |

* cited by examiner

*Primary Examiner* — Yong-Suk Ro
(74) *Attorney, Agent, or Firm* — Hulsey, P.C.

(57) ABSTRACT

A ram block assembly enables a very high shearing, breaking, or parting force by utilizing guide rails and passageways within the ram block assembly to accept the rails and gird the rails against deviation from intended trajectory. The ram block rails and cavities enable application of extreme forces, opposing and concentrated within a small area, when actuating the ram block assemblies into the "open" or "close" positions. The ram block assemblies move in opposition, approaching each other and applying opposing forces against any material positioned between the ram block assemblies, and deforming, severing, breaking, shearing, parting, tearing and/or cutting, as the case may be, any said material positioned between the ram block assemblies. The severing of materials in the wellbore is known as "shearing," and the apparatus performing this shearing operation as shear rams, shear ram blocks, shear blocks or shears.

6 Claims, 26 Drawing Sheets

SECTION A-A

100

SECTION B-B

100

100

100

100

100

SECTION C-C

500

500

500

500

DETAIL D

600

DETAIL E

600

600

GUIDED LOCKING RAM BLOCKS

CROSS REFERENCE TO RELATED APPLICATIONS

This application further claims the benefit of the following provisional and non-provisional patent applications, which are here expressly incorporated by reference:

(1) 62/352,916 entitled "BLOWOUT PREVENTER," filed on Jun. 21, 2016; and (2) Ser. No. 15/413,109 entitled "INTENSIFIER RAM BLOWOUT PREVENTER" filed Jan. 23, 2017.

FIELD OF THE INVENTION

The disclosed subject matter relates to ram blocks in blowout preventers ("BOPs"). Ram blocks play a key role in pressure control through their use inside blowout preventers in the oil and gas industry. The disclosed subject matters relates to the reliable, efficient operation of ram blocks to complete a shearing operation and to remain fixed in the close position—the flow stopping position—indefinitely.

BACKGROUND OF THE INVENTION

A type of modern blowout preventer ("BOP") contains large metal blocks, ram blocks, that move to contact tubulars or other objects in the wellbore and shear, cut or break them into two pieces that are no longer contiguous. Some of these blowout preventers only shear tubulars without forming a seal in the wellbore, while other BOPs are designed to shear and seal the wellbore so that no flow of fluid or gas passes through the ram blocks, and hence the BOP. Stopping wellbore flow is the task of a shear-and-seal BOP, the last line of defense in uncontrolled wellbore pressure events.

In a shearing operation, the ram blocks may be required to remain in the close position—the position of stopping all flow through the wellbore—indefinitely. The ram blocks are pushed together in this situation and are held in place in this close position indefinitely. Mechanical locking mechanisms function to hold shear ram blocks in place until wellbore pressure has been controlled by other means. These two functions, shearing tubulars and subsequently retaining that close position to stop flow indefinitely, have presented significant challenges to the oil and gas industry.

BRIEF SUMMARY OF THE INVENTION

The disclosed subject matter has the advantage of focusing two opposing ram block forces within a small area by using guide rails to maintain proper ram block trajectory. Upon shearing and reaching the close position, the disclosed subject matter has the advantage of a superior locking mechanism that locks the ram blocks in the close position with dogs or latches that directly contact the ram blocks themselves.

In disclosed embodiments, a ram block assembly enables a very high shearing, breaking, or parting force by utilizing guide rails and passageways within the ram block assembly to accept the rails and gird the rails against deviation from intended trajectory. The ram block rails and cavities enable application of extreme forces, opposing and concentrated within a small area, when actuating the ram block assemblies into the "open" or "close" positions. The ram block assemblies move in opposition, approaching each other and applying opposing forces against any material positioned between the ram block assemblies, and deforming, severing, breaking, shearing, parting, tearing and/or cutting, as the case may be, any said material positioned between the ram block assemblies. The industry describes the severing of materials in the wellbore as "shearing," and the apparatus performing this shearing operation as shear rams, shear ram blocks, shear blocks or shears.

In this disclosure, movement along the rails occurs within designed, controlled tolerances between rail and rail passageway sizes, effectively keeping the ram block assemblies aligned on an intended path to a target area of the opposing forces. The target area of opposing forces is intended to be relatively small in order to concentrate the opposing forces in a small area and better effect the parting of any material positioned between the ram block assemblies.

The ram blocks in this disclosure may be used to shear material in the wellbore or to perform the dual function of shearing the material in the wellbore and sealing the wellbore. If performing both shearing and sealing functions, the ram blocks will contain grooves or cavities for the placement of seals. An embodiment in this disclosure shows ram blocks with grooves for seals. In this particular embodiment, the seals will form a seal on both top, and bottom, of the ram blocks.

There is a deficiency in the current blowout preventer ram block assembly art that causes less than peak, or less than optimal, concentration of opposing forces on a target object in shearing operations. The path, or trajectory, of opposing ram block assemblies is not controlled within strict parameters. Current blowout preventer ram block assemblies move within a cavity inside the blowout preventer body. In traditional blowout preventers with traditional ram block assemblies, the ram block assembly moves in a trajectory merely defined by the exterior of the ram block assembly and its proximity to the interior of the blowout preventer body. In other words, the shapes of, and tolerances between, a large ram block assembly and the interior of a relatively massive blowout preventer are the only means of keeping the ram block assemblies in line toward the area where opposing forces are intended to converge and shear material in the wellbore. In these traditional blowout preventers, a significant portion of the ram block's mass and form move into the open wellbore cavity in a close operation. In the open wellbore, a lesser portion of the confining surface of the BOP interior remains in contact with the ram blocks as the close operation progresses. As the ram blocks encounter an object in the wellbore and attempt to shear it, the ram blocks diverge from their intended trajectory. The intended trajectory aims to apply forces to ram blocks with shearing blades whose edges approach each other on different parallel planes yet planes in very close proximity. Yet in practice, and under significant force, pressure and flow conditions, the ram block assemblies tend to deviate, diverge, cock, heel or veer from the intended trajectory. Traditional BOP ram blocks thus struggle to maintain an intended trajectory and consequently apply forces to unfavorable areas of the target wellbore material that make shearing difficult.

A common tendency in traditional BOP ram blocks is for the ram block assembly on the upper proximate plane to diverge from parallel with its leading edge moving at an upwardly increasing angle and for the ram block assembly on the lower proximate plane to diverge from parallel with its leading edge at a downwardly increasing angle. This effect is relatively analogous to a pair of scissors that encounters a very thick material which tends to force the opposing blades apart as they contact the thick material. In ram block assemblies as in scissors, the problem is exacerbated by loose tolerances or excessive "play" in the mechanism controlling the intended trajectory of the forces being applied. Traditional BOP ram blocks utilize this imprecise means of controlling trajectory and application of opposing forces that affects shearing results.

Embodiments in this disclosure provide a more robust and more precise means of applying the opposing forces where they are intended to converge. The present invention minimizes the tendency of ram blocks to deviate, veer, diverge, cock, heel, or divert from their intended trajectory with its guide rails and through guide rail passageways in ram blocks.

A disclosed embodiment has interchangeable ram blocks. A ram block may be removed from one side of the BOP, rotated 180 degrees about the longitudinal center line, and inserted into the other side. Guide rails may be arranged to preclude improper insertion. In other words, the ram block would not fit, i.e. would not accept the opposing ram block and guide rails, unless first rolled over so that it appropriately mates guide rails and passageways.

In disclosed embodiments, the ram block locking mechanism, the means of retaining a ram block in the close position, operates by directly immobilizing the rear end of a ram block through direct contact of a retaining member with the rear end of that ram block. This type of mechanism differs from the known art in the industry by directly, within the cavity exposed to wellbore pressure, obstructing the possible rearward movement of the ram block so that it remains in the close position. Current industry practice involves locking the ram block in place by means of a screw, wedge lock, or other lock outside the cavity exposed to wellbore pressure.

In a disclosed embodiment, the locking mechanism advances a blocking dog, bar, or other form to block the rearward movement of the ram block during a close operation so as to mechanically lock the ram block in the close position for an indefinite period of time.

In a disclosed embodiment, a locking mechanism utilizes a latch with a catch that closes to hold the rear end of ram block. This locking mechanism stops rearward movement of the ram block during a close operation so as to mechanically lock the ram block in the close position for an indefinite period of time.

BRIEF DESCRIPTION OF THE DRAWINGS

The present subject matter will now be described in detail with reference to the drawings, which are provided as illustrative examples of the subject matter so as to enable those skilled in the art to practice the subject matter. Notably, the FIGUREs and examples are not meant to limit the scope of the present subject matter to a single embodiment, but other embodiments are possible by way of interchange of some or all of the described or illustrated elements and, further, wherein.

DETAILED DESCRIPTION OF ILLUSTRATIVE EMBODIMENTS

Figure 1:
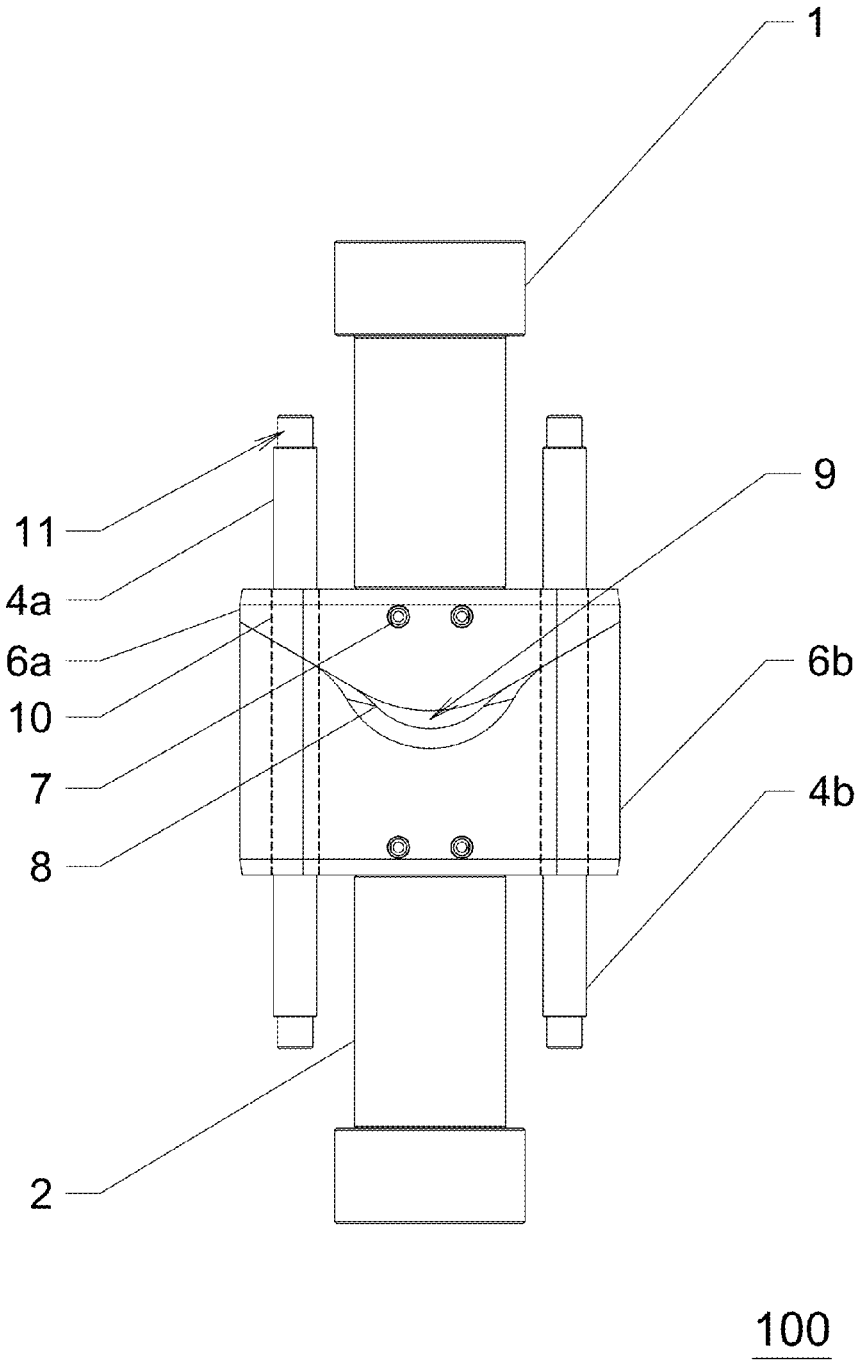
FIG. 1 shows an embodiment of the presently disclosed subject matter.

Referring to FIG. 1, this is Embodiment 100 and shown is an overhead view of two opposing ram blocks, upper ram block 6*b* and lower ram block 6*a*, in close position, each having traveled to close position by traveling along left guide rail 4*a* and right guide rail 4*b*. These guide rails, left guide rail 4*a* and right guide rail 4*b* pass through the guide rail passageways 10 bored through each opposing ram block. Each rail passes through each ram block. The guide rail passageway 10 is depicted by the dashed line in this overhead view. The edge of the ram blocks that contacts and shears the tubular or obstacle in a wellbore has a cutting edge 8 that shears material in the wellbore. Cutting edge 8 is a reference to an edge for cutting which may have a plurality of blades or segments or profiles. Cutting edge 8 segments are called out and described in more particularity below in this Detailed Description of the Drawings. The ram blocks are each attached to the ram piston 2 by ram block retaining members 7 that are inserted into a bored or milled cavity through the ram piston 2 and each of lower ram block 6*a* and upper ram block 6*b*. The ram cylinder 1 receives hydraulic fluid pressure, via means and mechanisms that are not shown but known in the art and widely employed in the oil and gas industry. As ram cylinder 1 receives hydraulic fluid pressure it is thereby urged toward the wellbore with the attached ram pistons 2 and ram blocks and achieving what is described herein as the "close position." This close position is shown in FIG. 1, the close position depicted here with lower ram block 6*a* and upper ram block 6*b* abutting one another. When an object or material is sheared in the wellbore with ram blocks, space is required for this sheared material to occupy. Sheared material relief space 9 depicts the space between ram blocks that sheared, parted material would occupy. In Embodiment 100, the guide rails, both 4*a* and 4*b*, attach to an unshown BOP body or housing or module of any manufacturer, at guide rail attachment points 11. In Embodiment 100, it is envisioned that guide rail attachment points 11 would be inserted into an appropriate receiving cavity and potentially retained in place with pins, although pins are not shown.

Figure 2:
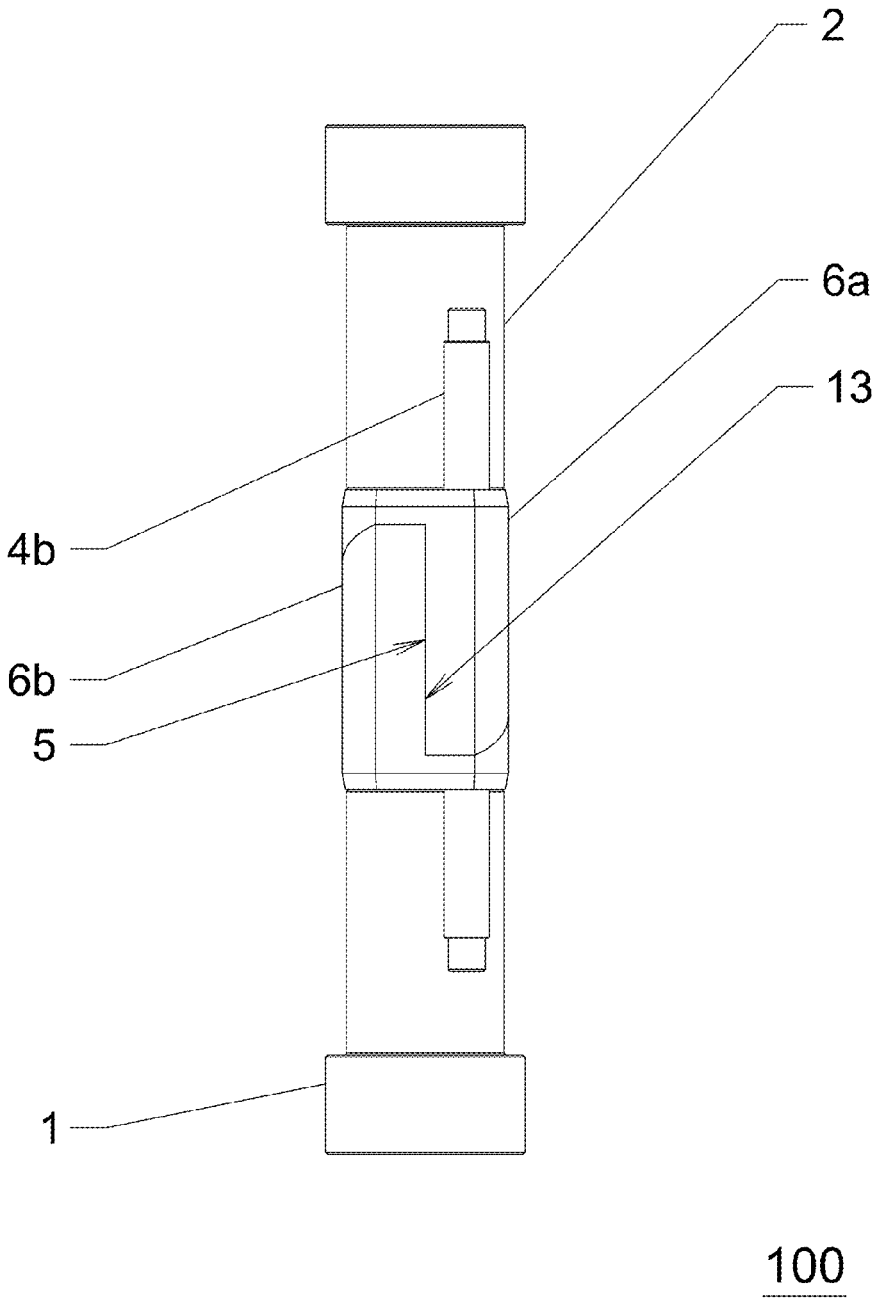
FIG. 2 presents a side view is shown of two opposing ram blocks in the close position.

Referring to FIG. 2, a side view is shown of two opposing ram blocks in the close position. As in FIG. 1, the ram blocks have traveled to close position along guide rails with left guide rail 4*b* visible and assisting straight travel for lower ram block 6*a* and upper ram block 6*b*.

Figure 3:
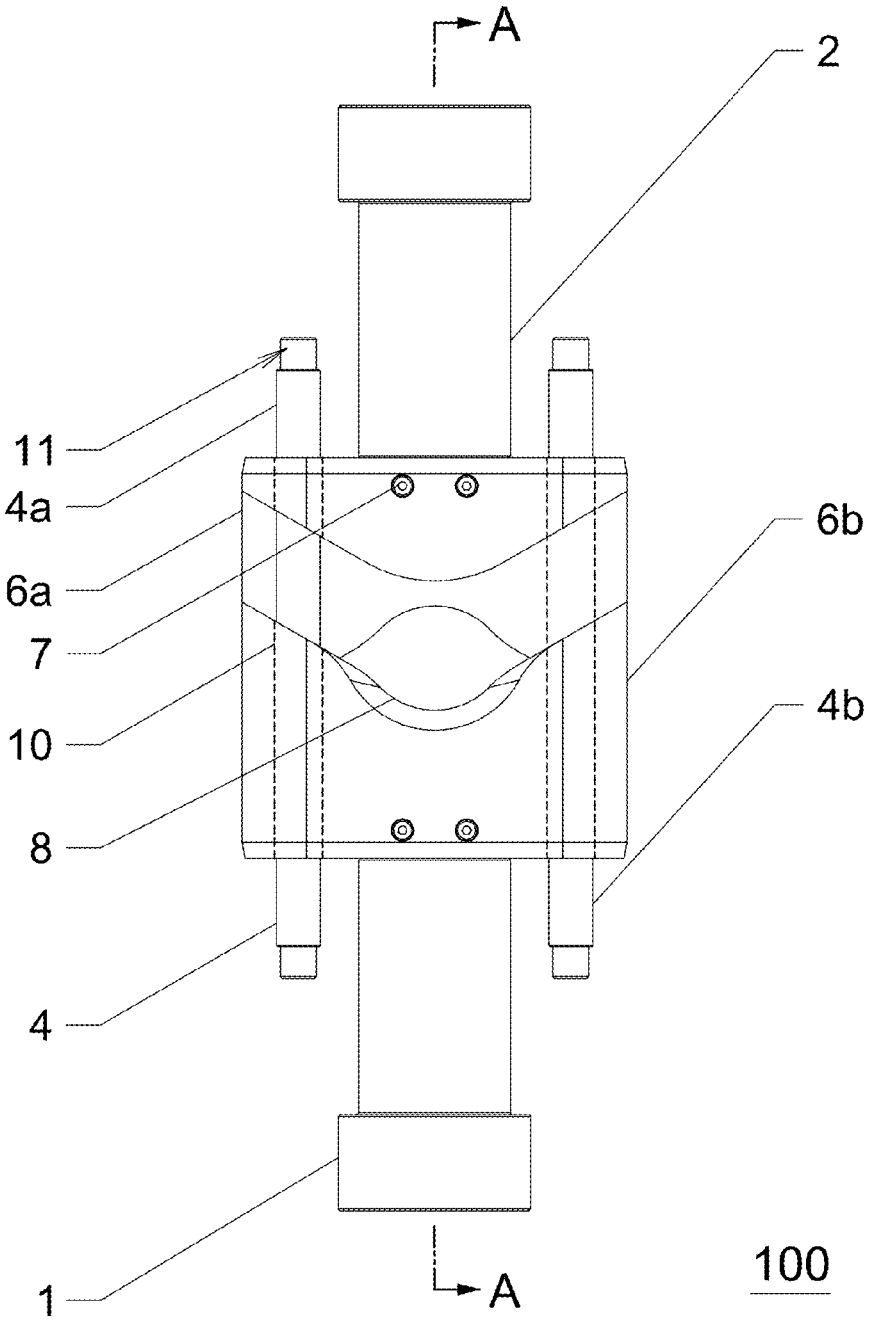
FIG. 3 depicts an overhead view of the presently disclosed subject matter with two opposing ram blocks in partial close position.

Referring to FIG. 3, an overhead view is shown with two opposing ram blocks in partial close position, having not yet reached the close position shown in FIG. 1. In this position, wellbore flow would still pass through the space between ram block 6*a* and ram block 6*b*. Each ram block is traveling along guide rails, with left guide rail 4*a* visible from above. FIG. 3 shows where a cross section, Section A-A, is taken for representation in FIG. 4.

Figure 4:
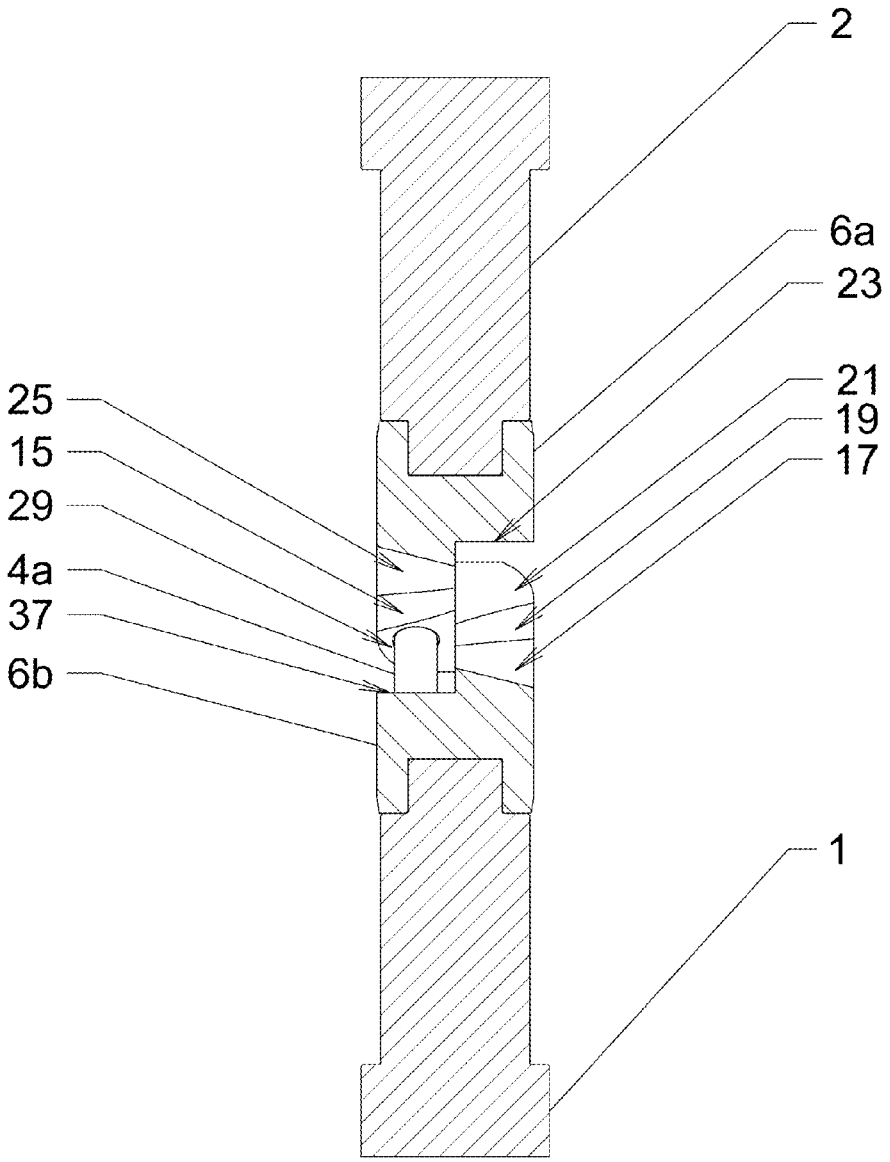
FIG. 4 provides a side view cross section of two opposing ram blocks in partial close position, in the same relative position to each other as in FIG. 3

Referring to FIG. 4, Section A-A, a side view cross section, as noted in FIG. 3, shows two opposing ram blocks in partial close position, in the same relative position to each other as in FIG. 3, having not yet reached the close position shown in FIG. 1. Both ram block 6*a* and ram block 6*b* travel along guide rails, with left guide rail 4*a* visible beyond the cross section cut. Various portions of cutting edge 8 of FIG. 1 are shown here and noted with particularity. These cutting edge profiles are upper ram block center cutting edge 17, upper ram block right near lateral cutting edge 19, upper ram block center cutting edge 21, lower ram block center cutting edge 25, lower ram block near lateral cutting edge 15, lower ram block far lateral cutting edge 29. These cutting edge profiles are designed to center, in the wellbore and between the opposing ram blocks, any material to be sheared. These cutting edge profiles tend to gather, rake, pull and urge material to be cut to the central area between the opposing ram blocks and thus to the center of the wellbore as well. The cutting edge profiles may be arranged differently that shown in the drawings. Although the drawings depict the cutting edges as being a solid portion that is one with the ram block, embodiments not shown may include attachable blades or inserts as is common in the BOP industry. Regarding the cutting edges, this embodiment emphasizes a basic form intended to gather target material toward the midline of the ram blocks and toward the center of the wellbore. This embodiment does not emphasize specific shapes, materials, or replaceable blades or inserts that are common in the BOP industry. One edge of upper ram block underside relief space 37 and lower ram block underside relief space 23 are shown in opposition to the various cutting edges of opposing ram blocks. Again, the relief space provided by 37 and 23 is necessary to accommodate the mass of the sheared material ends or pieces.

Figure 5:
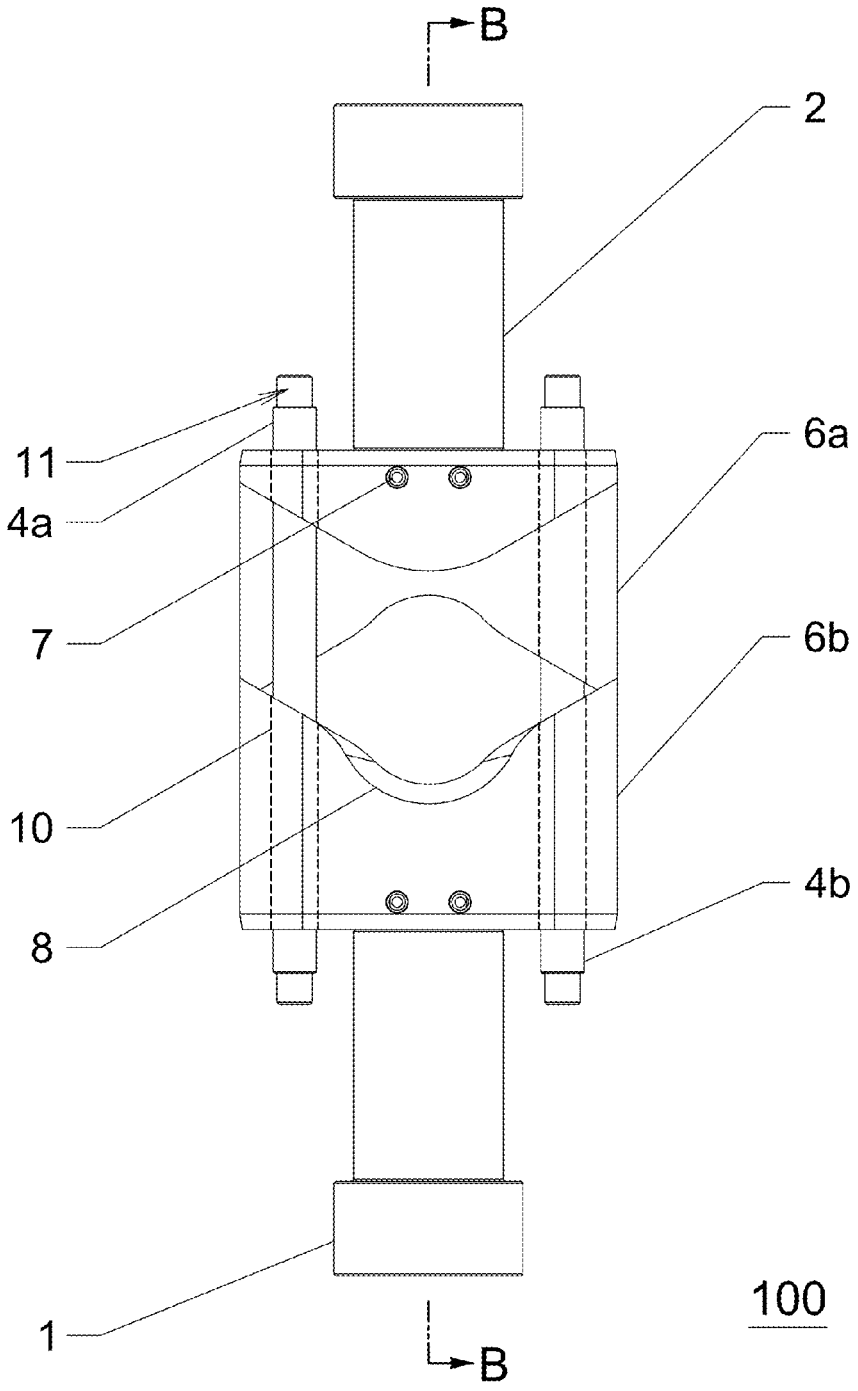
FIG. 5 shows an overhead view of an embodiment of the present disclosure with two opposing ram blocks in the open position.

Referring to FIG. 5, shown is an overhead view of Embodiment 100 with two opposing ram blocks in the open position. In this view, the ram blocks have not begun travel to the close position and the wellbore flow remains unimpeded. A tubular or other obstacle in the wellbore could occupy the open space visible between the ram blocks. Ram blocks travel along guide rails, with left guide rail 4*a* visible. From this open position, upper ram block 6*b* and lower ram block 6*a* will travel toward a close position, and in the process, contacting and shearing, breaking, cutting or parting any material between them until the ram blocks abut one another as in FIG. 1. As noted above, guide rail attachment points 11 are attached to a BOP body or housing of any given manufacturer and retain left guide rail 4*a* and right guide rail 4*b*. A cross section is taken as noted for Section B-B which is shown in FIG. 6.

Figure 6:
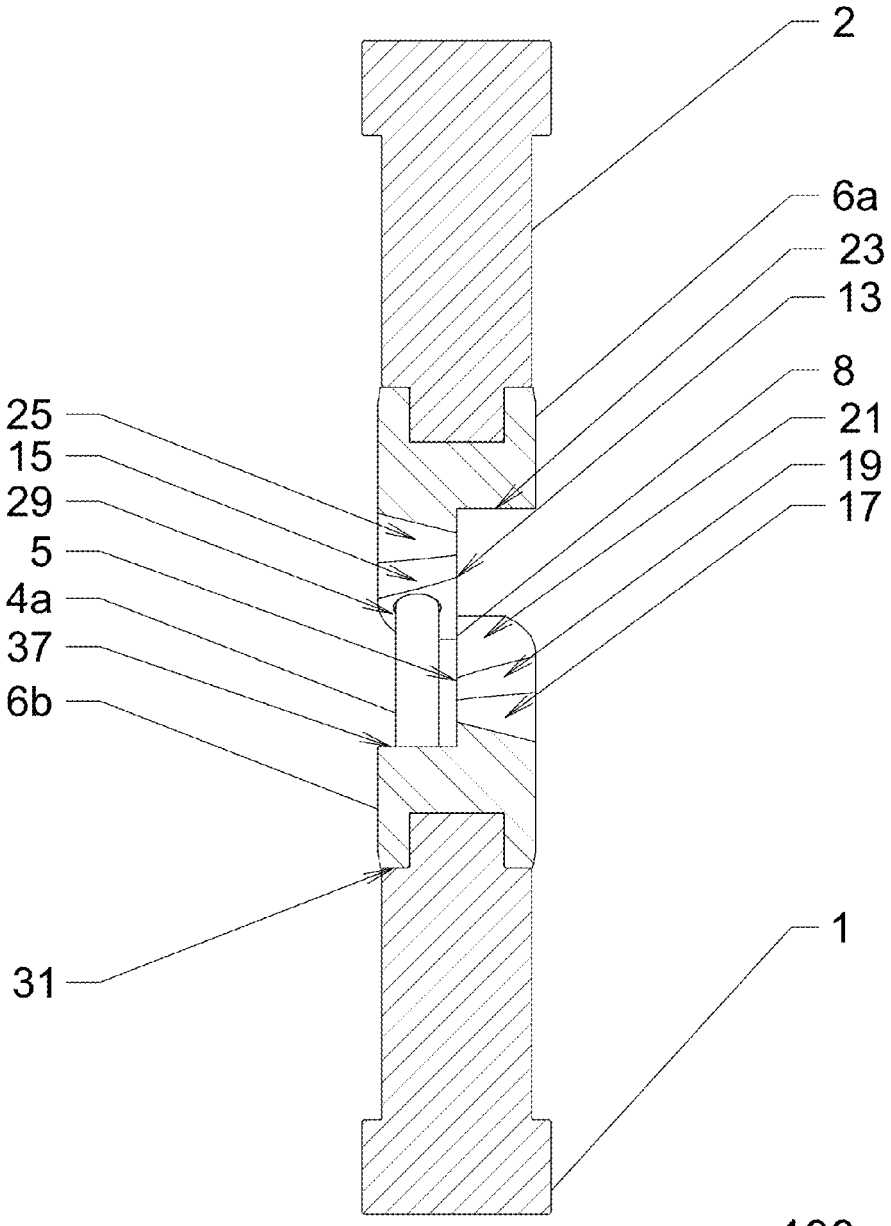
FIG. 6 presents a cross section showing two opposing ram blocks in the open position, having not yet begun travel toward each other and toward the close position.

Section B-B on FIG. 6 is a cross section that shows two opposing ram blocks in the open position, having not yet begun travel toward each other and toward the close position depicted in FIG. 1. The ram blocks are in the same relative position to each other as in FIG. 3. Each ram block travels along guide rails, with guide rail 4*a* visible beyond the section cut along with upper ram block center cutting edge 17, upper ram block right near lateral cutting edge 19, upper ram block center cutting edge 21, lower ram block center cutting edge 25, lower ram block near lateral cutting edge 15, lower ram block far lateral cutting edge 29. Upper ram block underside relief space 37 and lower ram block underside relief space 23 are shown in opposition to the various cutting edges of opposing ram blocks. The surfaces under the cutting edges are upper ram block proximal to cutting edge underside face 5 and lower ram block proximal to cutting edge underside face 13. The ram piston attachment boss 31, through which ram block retaining members 7 will pass into ram piston 2, is shown.

Figure 7:
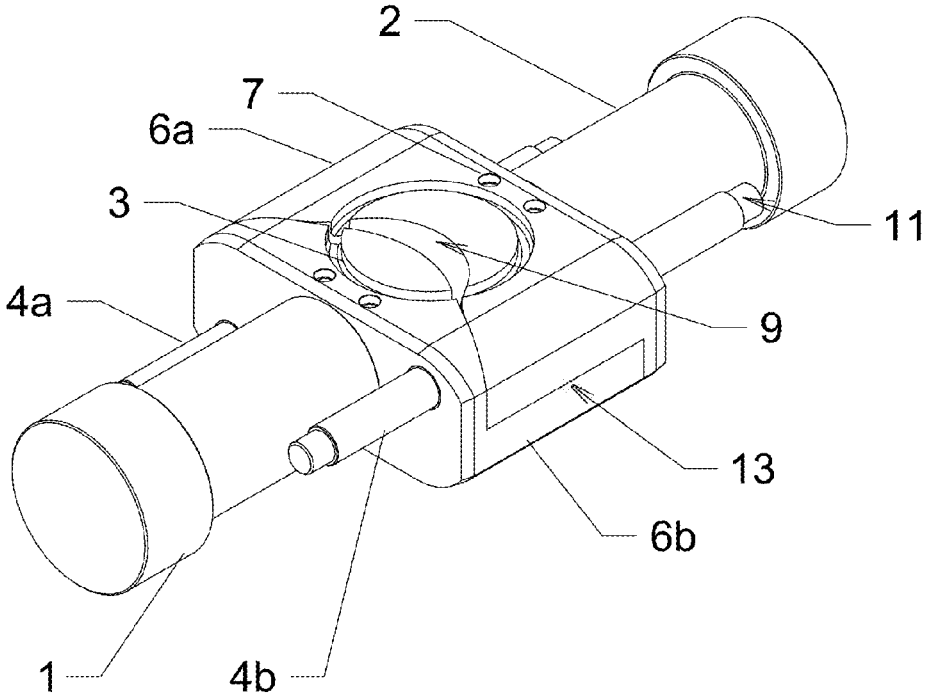
FIG. 7 provides a perspective view of the exterior of upper ram block and lower ram block in the close position.

Referring to FIG. 7, shown is a perspective view of the exterior of upper ram block 6*b* and lower ram block 6*a* in the close position as in FIG. 1. Guide rail attachment points 11 are shown, depicted as a shoulder and able to mate with BOP body 528 as shown herein as on FIG. 16 and FIG. 17. As known in the art, ram blocks intended for shearing and sealing include seal grooves into which seals are placed. A portion of seal groove 3 is shown as a channel ring in the visible portions of upper ram block 6*b* and lower ram block 6*a* around sheared material relief space 9. For clarity in these drawings, seal groove 3 is omitted from the majority of the drawings, although seal groove 3 could potentially be present, or absent, from any of the embodiments herein, as known to those with ordinary skill in the art. It is important to note that in Embodiment 100, both ram blocks 6*a* and 6*b* are interchangeable. This is understandable from this perspective view in FIG. 7. For example, lower ram block 6*a* could be pulled away from the wellbore until free of any constraining guide rails and free of the unshown BOP. It then could be rotated 180 degrees along its longitudinal axis—rolled over to its other side, in other words—and moved to the other side of a given BOP and inserted. Upper ram block 6*b* and lower ram block 6*a* are interchangeable in Embodiment 100, but they are not required to be interchangeable in order for Embodiment 100 or other embodiments to function correctly.

Figure 8:
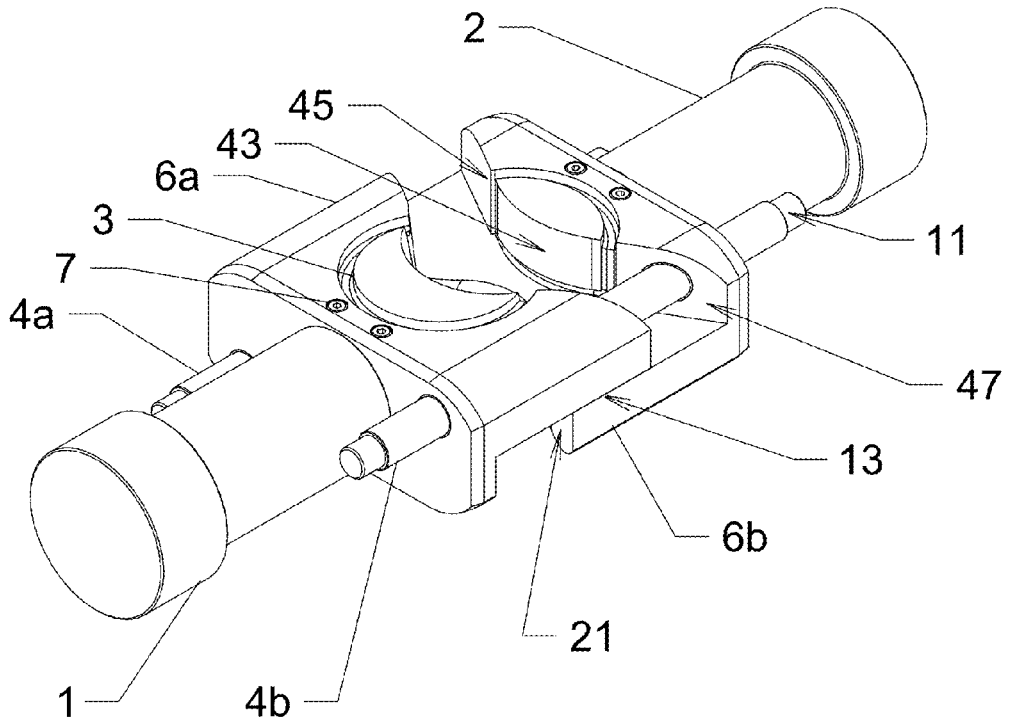
FIG. 8 illustrates a perspective view of the exterior of upper ram block and lower ram block in a partial close position.

Referring to FIG. 8, shown is a perspective view of the exterior of upper ram block 6*b* and lower ram block 6*a* in the partial close position as in FIG. 3. In FIG. 8, as compared to FIG. 7, the ram blocks are rotated 180 degrees along the longitudinal axis, with the ram blocks showing different faces. As discussed above, this shows the sameness and interchangeability of 6*a* and 6*b*. Additionally, examining FIG. 8 and FIG. 7 seal grooves 3 present on both drawings, seals can be inserted to seal both the top and bottom of these ram blocks. Guide rail attachment points 11 are shown, depicted as a shoulder and mating with BOP body 528 as shown herein as on FIG. 16 and FIG. 17. As known in the art, ram blocks intended for shearing and sealing include seal grooves into which seals are placed. A portion of seal groove 3 is shown as a channel ring in the visible portions of upper ram block 6*b* and lower ram block 6*a* around sheared material relief space 9. In viewing FIG. 8 in comparison to FIG. 7, taking into account the 180 degree longitudinal rotational difference, it becomes clear that seal groove 3 is present on top and bottom sides of the ram blocks. For clarity in these drawings, seal groove 3 is omitted from the majority of the drawings, although seal groove 3 could potentially be present, or absent, from any of the embodiments herein, as known to those with ordinary skill in the art. In this partial close position, surfaces providing and adjacent to sheared material relief space 9 are shown. On upper ram block 6*b* are upper ram block relief space center face 43, upper ram block relief space left rear space 45, and upper ram block relief space right near face 47.

Figure 9:
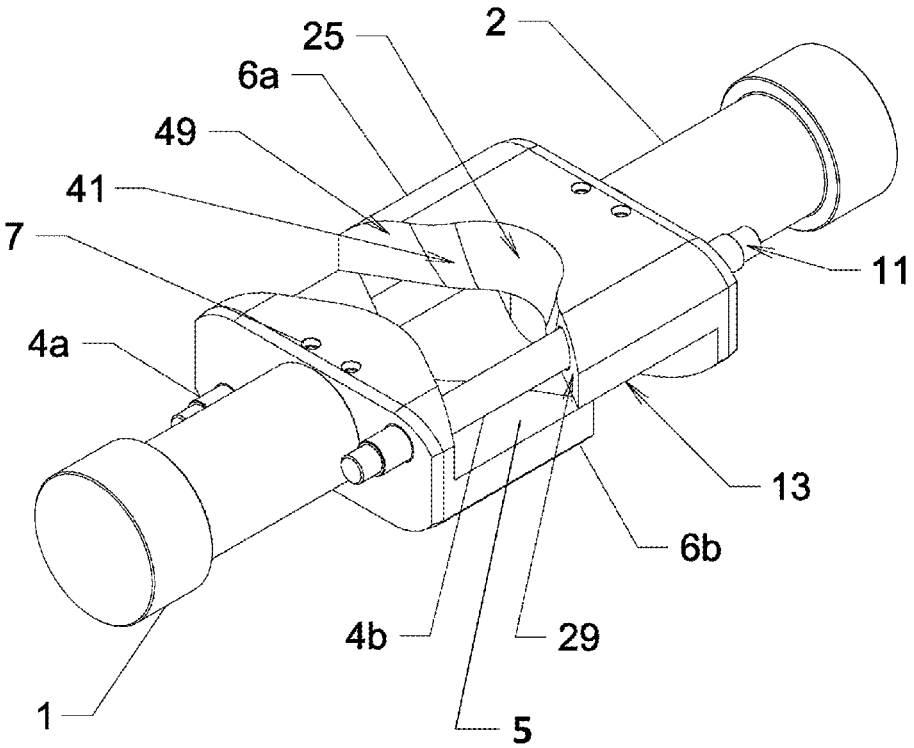
FIG. 9 depicts a perspective view of the exterior of upper ram block 6*b* and lower ram block 6*a* in the open position.

Referring to FIG. 9, shown is a perspective view of the exterior of upper ram block 6*b* and lower ram block 6*a* in the open position as in FIG. 5. In FIG. 9, as compared to FIG. 8, the ram blocks are rotated 180 degrees along the longitudinal axis, with the ram blocks showing different faces. The ram blocks are thus shown in the same orientation as FIG. 7 in relation to the longitudinal axis. In this open position, surfaces providing and adjacent to sheared material relief space 9 are shown. On lower ram block 6*a* are shown lower ram block center cutting edge 25, lower ram block near lateral cutting edge 41, lower ram block far lateral cutting edge 49. Cutting edge underside face 13 lies under the shown portion of lower ram block 6*a*. In this open position, note that the ram blocks are already fully engaged with the guide rails passing through and beyond them. A close operation thus begins with the ram blocks well supported and girded by these guide rails. The guide rails may be constructed with substantial diameters that resist flex.

Figure 10:
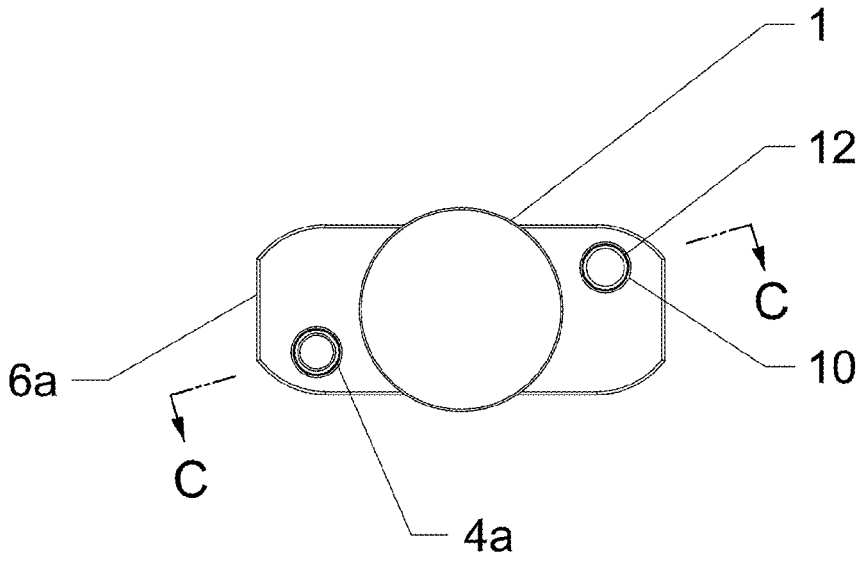
FIG. 10 presents an end view of lower ram block and ram cylinder, left guide rail, guide rail passageway, and guide rail bearing.

An end view of lower ram block 6*a* and ram cylinder 1, left guide rail 4*a*, guide rail passageway 10, guide rail bearing 12 is shown in FIG. 10. The guide rail bearing may be a plain bearing and consisting of a low friction, lubricated, or lubricant impregnated material commonly in use for sleeve-type bearings. This guide rail bearing may have wiper seals, which are not shown, to keep wellbore debris from entering the space between guide rail passageway 10 and guide rail bearing 12. This view depicts Embodiment 100, that is the same as FIGS. 1-9. Embodiment 100 has two guide rails that pass through each ram block. This Embodiment 100 differs from Embodiment 200 in FIG. 12, which is shown to have four guide rails that pass through each ram block. A diagonal cross section, Section C-C, is taken from FIG. 10 and shown in FIG. 11.

Figure 11:
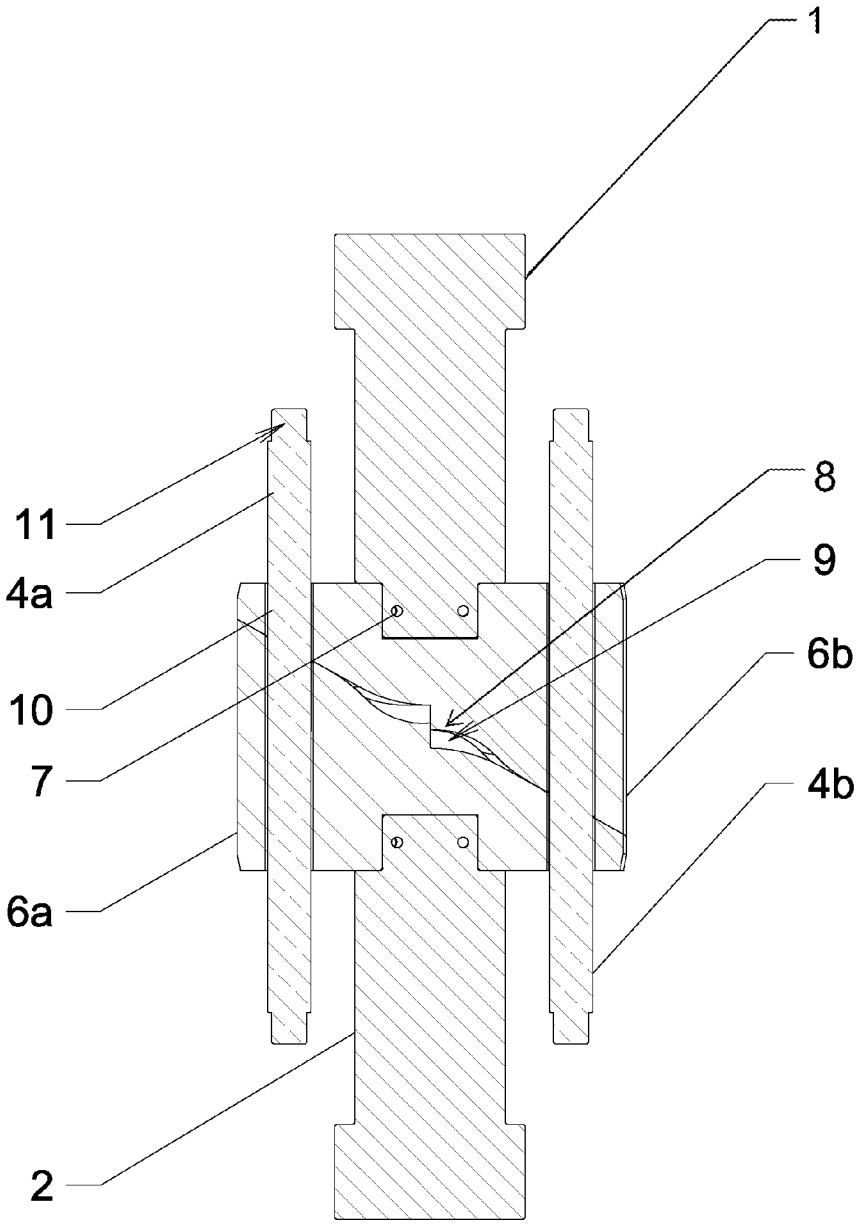
FIG. 11 provides a cross section, Section C-C, taken from a diagonal cross section view.

A cross section, Section C-C, is shown in FIG. 11 and taken from a diagonal cross section view as referenced on FIG. 10 and shown in the close position. Upper ram block 6*b* and lower ram block 6*a* are seen abutting each other. Sheared material space 9 is clearly shown, providing space for sheared or parted materials following a close operation.

Figure 12:
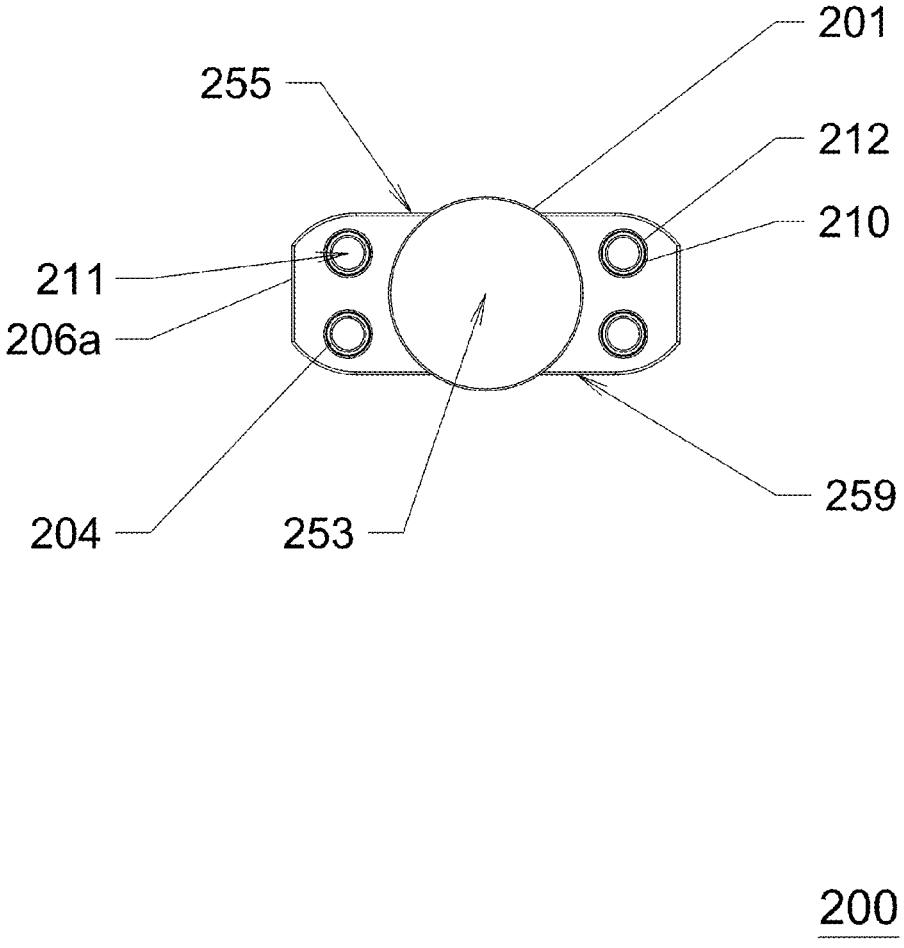
FIG. 12 depicts is an alternative embodiment of the presently disclosed subject matter.

Referring to FIG. 12, depicted is an alternative embodiment, Embodiment 200, whose main differentiating feature is four guide rails as opposed to the two guide rails in Embodiment 100. In all of the disclosed Embodiments, a plurality of guide rails is possible, and an even number, such as two, or in the case of Embodiment 200, four, is most practical for two ram blocks. Guide rail passageway 210 passes through the ram blocks in four places in 200 instead of only two in 100. Shown are ram cylinder 201, guide rail passageway 210, guide rail bearing 212, guide rail attachment point 211, guide rail 204, lower ram block 206*a*, ram cylinder rear face 253, top portion of ram blocks 255, bottom portion of ram blocks 259. The advantage of Embodiment 200, as shown with four guide rails 204, is added directional stability for attaining the desired straight trajectory for ram blocks to converge at a target shear material. Embodiment 200 may require larger ram blocks and potentially a larger BOP body in comparison with Embodiment 100.

Figure 13:
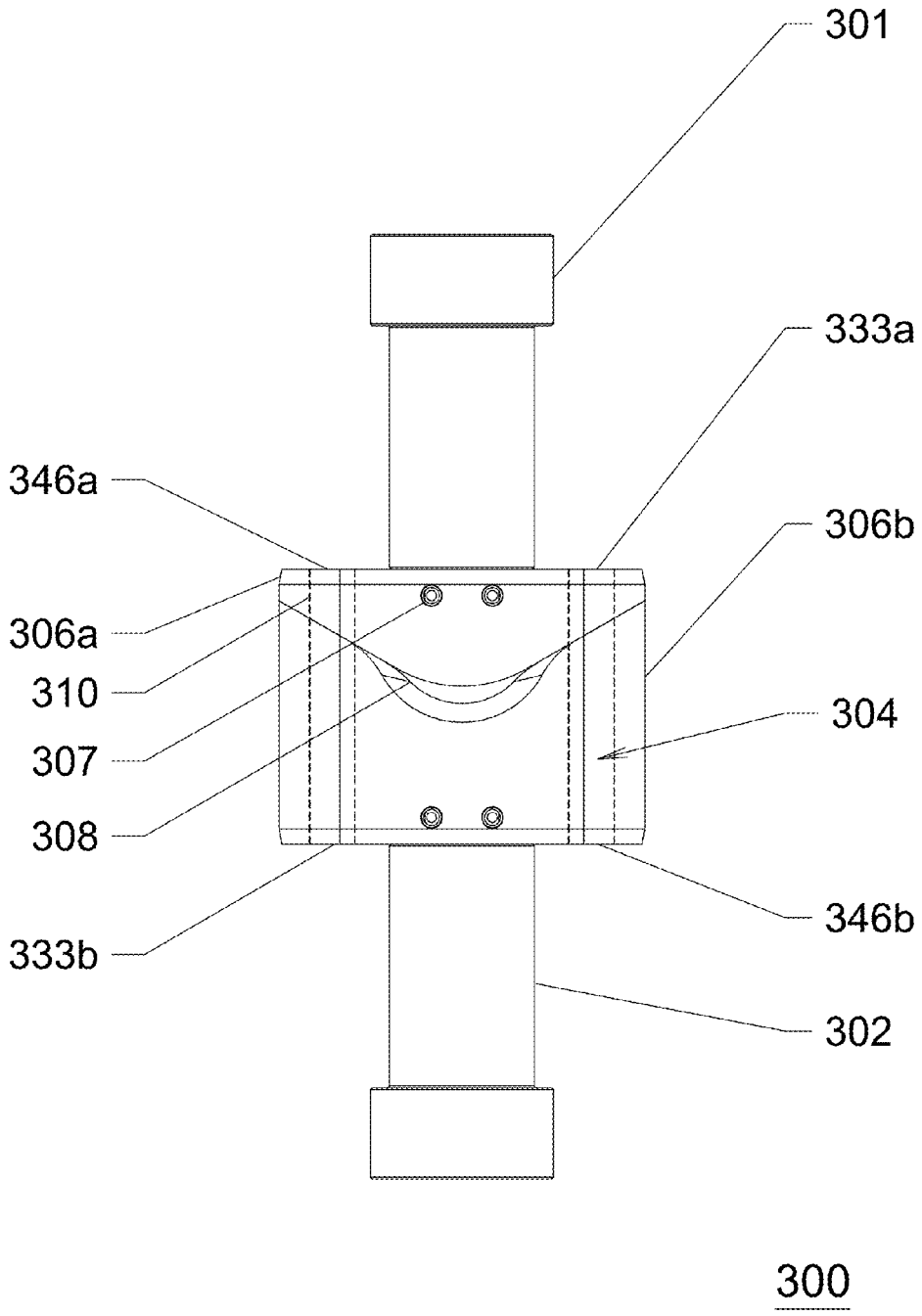
FIG. 13 shows another embodiment with an overhead view of a upper ram block and lower ram block in close position.

Another embodiment, Embodiment 300, is depicted in FIG. 13 with an overhead view of upper ram block 306*b* and lower ram block 306*a* in close position, each having traveled to close position by traveling along guide rails, that are not visible, inside guide rail passageways 310. Some BOPs, or BOP manufacturers, may not accommodate the attaching, inserting or retaining of guide rails or guide rail attachment points. A less intrusive, self-sufficient set of ram blocks may be required. FIG. 13 introduces Embodiment 300, which has short guide rails that do not attach or insert into a BOP body, but rather attach from one end of the guide rail to the rear end of a ram block. In Embodiment 100, the left guide rail 4*a* and right guide rail 4*b* are stationary and attach to or insert into the BOP body at guide rail attachment points 11. In contrast, guide rails in Embodiment 300 affix to the rear end of the ram blocks with the distal or leading end free to travel inside guide rail passageway 310 with ram block advancement toward the close position. A guide rail attaches at upper ram block rear end 333*b* in upper ram block 306*b* adjoining guide rail passageway 310 and another guide rail attaches at lower ram block rear end 333*a* in lower ram block 306*a* adjoining guide rail passageway 310. In the close position as shown in FIG. 13, guide rails end their travel to the close position inside guide rail passageway 310 flush with the rear end of the opposing ram block. The advantage of guide rails that do not affix to a given BOP body is that they may be easily adapted and placed within different BOP bodies when time or design constraints do not permit modification of a BOP body to accept attached, stationary guide rails. Guide rails would be of sufficient length so that the distal or end of a guide rail when viewed from an attachment point such as upper ram block rear end 333*b* would already be position inside opposing upper ram block's 306*a* guide rail passageway 10 when it begins travel to the close position. The guide rail has a "start" within the opposing ram block to expedite smooth travel in the desired trajectory to close position. Similar with Embodiment 100, this Embodiment 300 shows ram cylinder 301, ram piston 302, ram block retaining members 307 and cutting edge 308.

Figure 14:
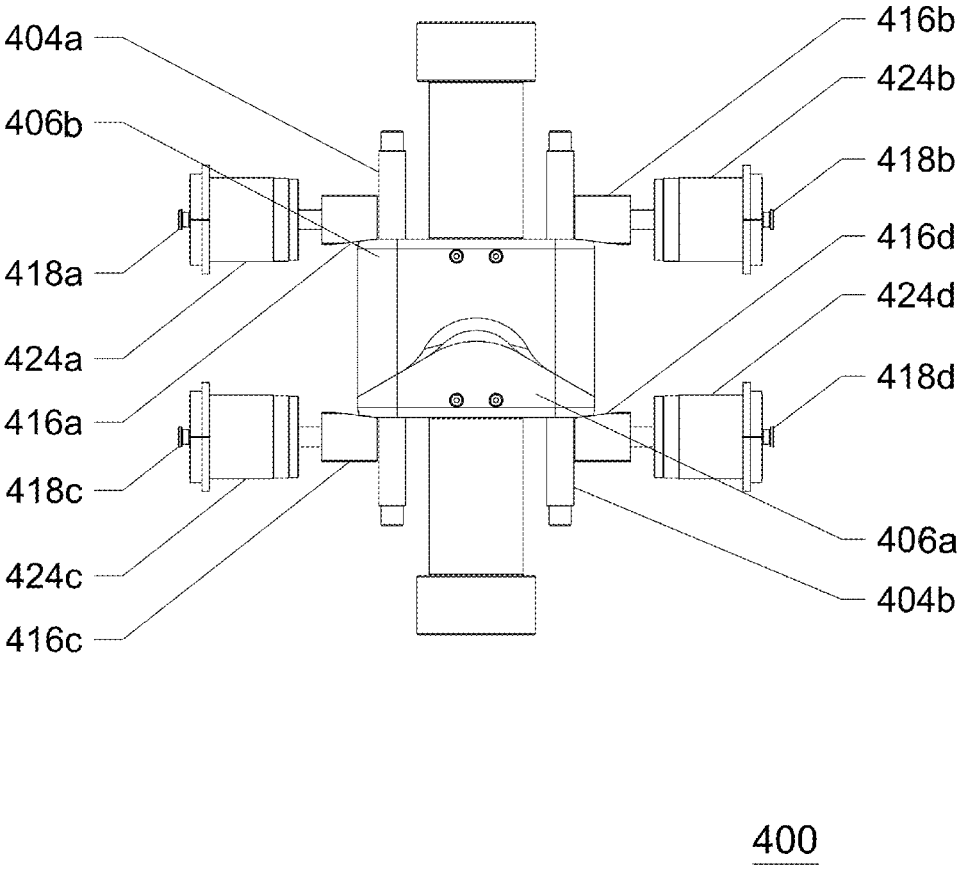
FIG. 14 presents a further embodiment as a means of locking or retaining the ram blocks in the close position.

Referring to FIG. 14, Embodiment 400 is shown and it depicts a means of locking or retaining the ram blocks in the close position. After shear-and-seal ram blocks have performed their key task and reached the close position, the wellbore would be sealed and flow stopped. It is critical that a reliable means be employed to maintain the ram blocks in the close position until any required operations take place. The means of locking or retaining the ram blocks in close position should hold indefinitely. Additionally, when the time comes to return to open position, the means of locking or retaining must release. FIG. 14 depicts a novel means of placing an impeding member, or "dog," directly behind, and in direct contact with, a ram block.

FIG. 14 is an overhead view of opposing ram blocks in close position, but depicted with locking dogs 416*a*, 416*b*, 416*c* and 416*d* retaining the ram blocks in the close position in order to prevent wellbore pressure or other forces from separating the ram blocks. FIG. 14 represents Embodiment 400 and includes means of locking the ram blocks in position and otherwise is shown with ram blocks and rails of Embodiment 100, although Embodiments 200 and 300 are equally compatible with 400. In the top left of FIG. 14, left side top locking dog 416*a* has been urged to abut the rear external edge of a ram block by left side top hydraulic actuator 424*a*. As needed, or in the event of a hydraulic failure or unforeseen event, left side top locking dog actuator piston external attachment point 418*a* permits external force, potentially through an external pulling device, to be applied to retract left side top locking dog 416*a* from the shown close position to free the ram block. The four sets of locking components in FIG. 14 are identical except for orientation about the ram blocks. These components, grouped by left top, left bottom, right top, and right bottom orientation are: left side top locking dog 416*a*, left side top hydraulic actuator 424*a*, and left side top locking dog actuator piston external attachment point 418*a*; left side bottom locking dog 416*c*, left side bottom hydraulic actuator 424*c*, and left side bottom locking dog actuator piston external attachment point 418*c*; right side top locking dog 416*b*, right side top hydraulic actuator 424*b*, and right side top locking dog actuator piston external attachment point 418*b*; and right side bottom locking dog 416*d*, right side bottom hydraulic actuator 424*d*, and right side bottom locking dog actuator piston external attachment point 418*d*.

Figure 15:
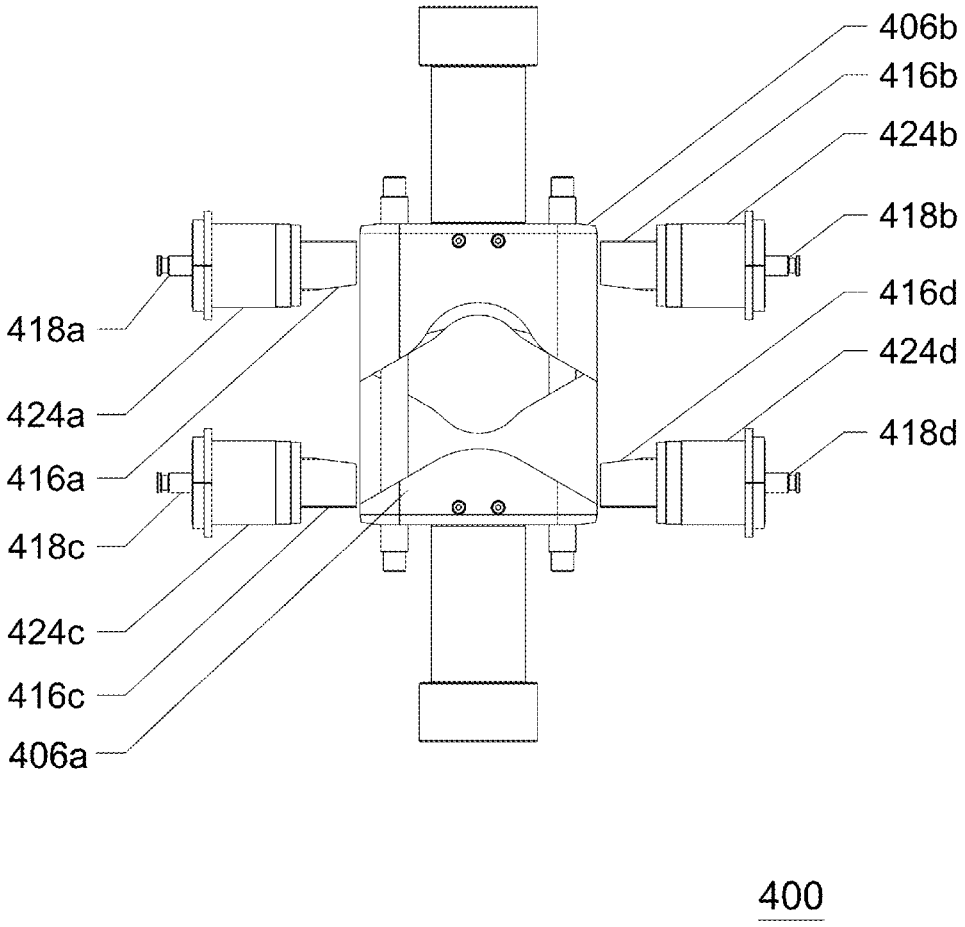
FIG. 15 contrasts with FIG. 14, showing an overhead view of opposing ram blocks in the open position with locking dogs.

FIG. 15, in contrast with FIG. 14, is an overhead view of opposing ram blocks in the open position with locking dogs such as locking dog 416*a* abutting the side of upper ram block 406*b* and not impeding ram block 406*b*'s travel.

Figure 16:
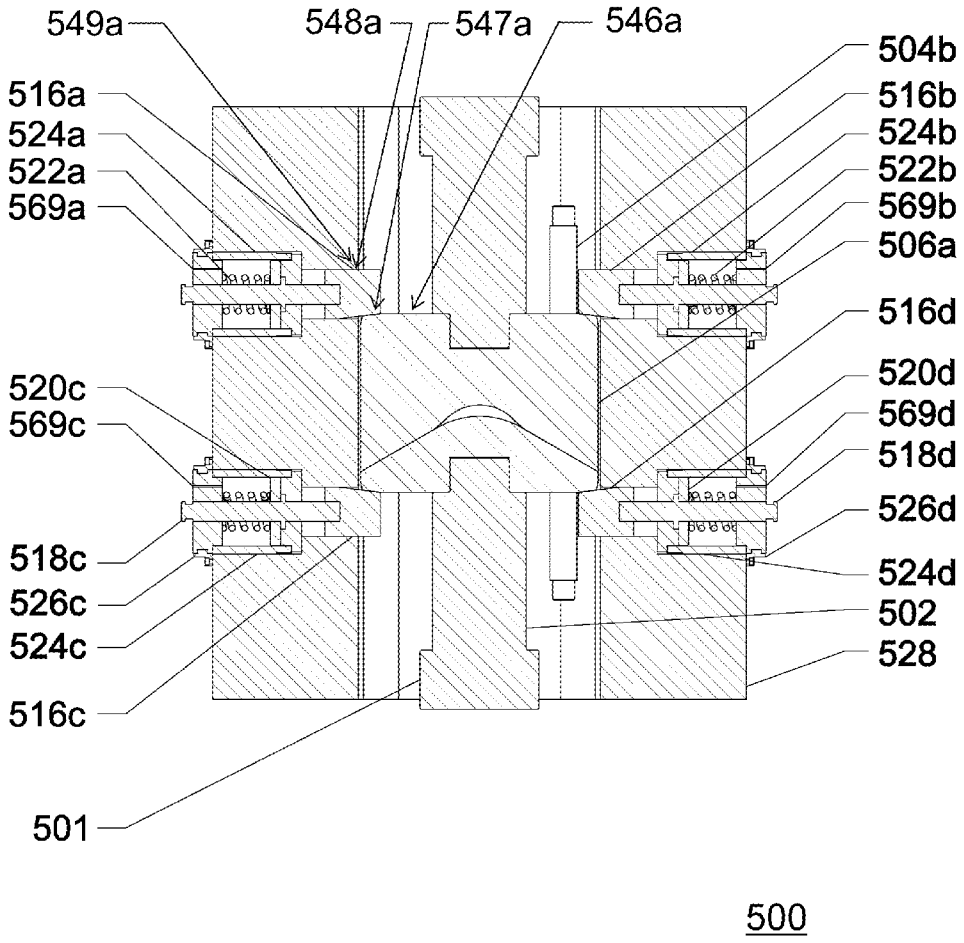
FIG. 16 shows a solid rectangle in cross section to make clear how these locking components could fit in the body of a BOP.

An exemplary BOP body has been omitted from most of the drawings for clarity. However, FIG. 16 shows a solid rectangle in cross section to make clear how these locking components could fit in the body of a BOP. FIG. 16 is an overhead cross section of showing the ram blocks locked in the close position as in FIG. 14. FIG. 16 adds a rectangle of metal to represent BOP body 528 in order to show how the locking components can be housed in a given BOP body. With the addition of a BOP body, FIG. 16 presents a different Embodiment, Embodiment 500. Visible on the right side of FIG. 16, and numbered with 500 series numbers as opposed to 400 series numbers on analogous FIG. 14, are right side guide rail 504*b*, right side top locking dog 516*b*, right side top hydraulic actuator 524*b*, and right side bottom locking dog actuator piston external attachment point 518*d*. The components associated with right side top hydraulic actuator 524*b* are shown. Open-assist spring 522*b* is in compression while the ram blocks are in the open position. Open-assist spring 522*b* keeps the right side top locking dog 516*b* pressed against lower ram block 506*a* while the ram blocks remain in the open position. When a close operation is initiated, the open-assist spring 522*b* will urge the tapered edge of right side top locking dog 516*b* over the rear edge of lower ram block 506*a* in advance of, or concurrently with, hydraulic fluid pressure actuation of through fluid port 569*b* of right side top hydraulic actuator. The travel of right side top locking dog 516*b* to the shown close position, along with the duplicate right side bottom locking dog 516*d*, left side bottom locking dog 516*c*, and left side top locking dog 516*a* serve to lock the ram blocks in the close position and prevent separation of the ram blocks due to wellbore pressure or other forces. At the lower right side of FIG. 16, hydraulic actuator cylinder 520*d* and right side bottom locking dog actuator piston external attachment point 518*d* are visible. These parts, and all components of 524*a*, 524*b*, 524*c* and 524*d* are the same and duplicated in each shown hydraulic actuator, whether enumerated specifically on each or not, and with the nomenclature "a," "b," "c," or "d" only differing to reflect location on FIG. 16.

Figure 17:
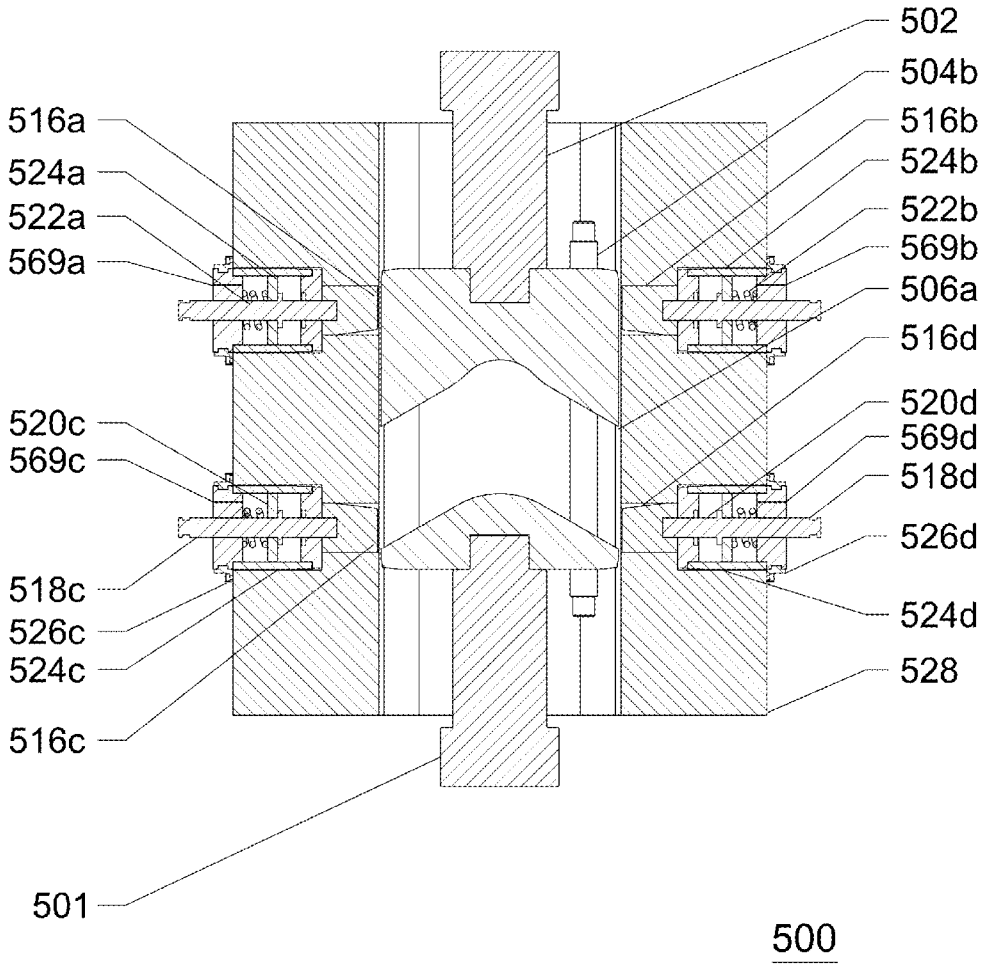
FIG. 17 provides an overhead cross section showing the ram blocks in the open position as in FIG. 15.

FIG. 17 is an overhead cross section showing the ram blocks in the open position as in FIG. 15. As in FIG. 16, FIG. 17 adds a generic rectangle of metal to represent BOP body 528 in order to show how the locking components can be housed in a given BOP body. The enumerated components are the same as in FIG. 16. All components of 524*a*, 524*b*, 524*c* and 524*d* are the same and duplicated in each shown hydraulic actuator, whether enumerated specifically on each or not, and with the nomenclature "a," "b," "c," or "d" only differing to reflect location on FIG. 17. Right side top locking dog 516*b*, along with the duplicate right side bottom locking dog 516*d*, left side bottom locking dog 516*c*, and left side top locking dog 516*a* are in the open position and not impeding movement of the ram blocks. Open-assist spring 522*b* is in compression while the ram blocks are in the open position, and open-assist spring 522*b* keeps the right side top locking dog 516*b* pressed against lower ram block 506*a* while the ram blocks remain in the open position. When a close operation is initiated, the open-assist spring 522*b* will urge the tapered edge of right side top locking dog 516*b* over the rear edge of lower ram block 506*a* in advance of, or concurrently with, hydraulic fluid pressure actuation of through fluid port 569*b* of right side top hydraulic actuator 524*b*.

Figure 18:
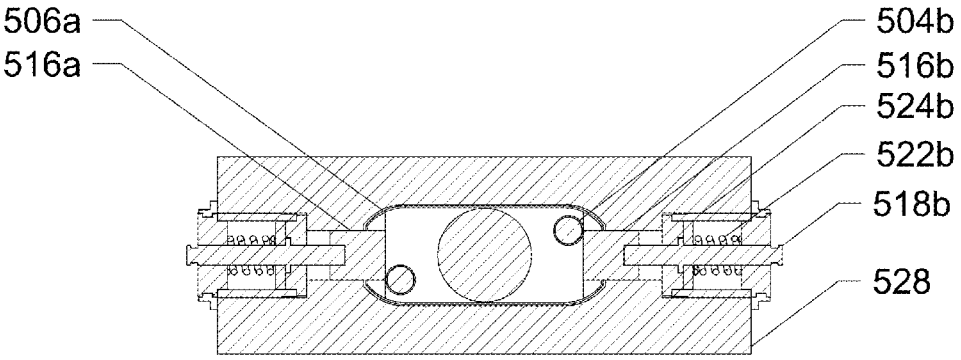
FIG. 18 is an end cross section showing the close position as in FIG. 16.

FIG. 18 is an end cross section showing the close position as in FIG. 16. The locking dogs, right side top locking dog 516*b* and left side top locking dog 516*a*, hold lower ram block 506*a* in the close position and prevent it from moving, in this case potential movement being toward the observer of the drawing. A BOP body 528 houses the ram blocks and components of the hydraulic actuators.

Figure 19:
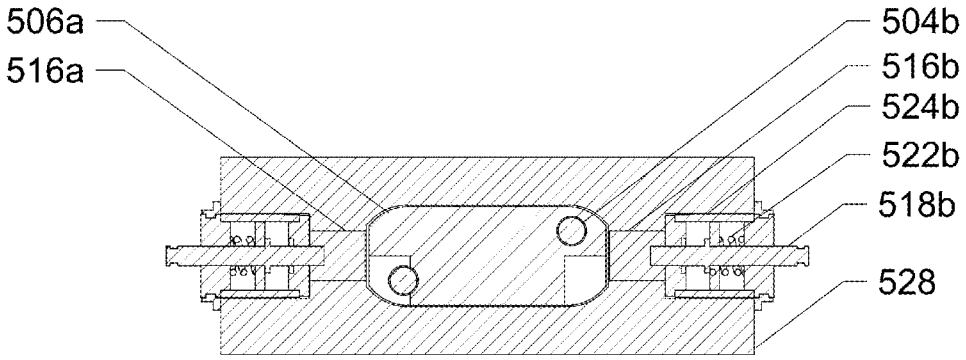
FIG. 19 is an end cross section showing the open position as in FIG. 17.

FIG. 19 is an end cross section showing the open position as in FIG. 17. Locking dogs are against the side of lower ram block 506*a*, and do not impede its movement.

Figure 20:
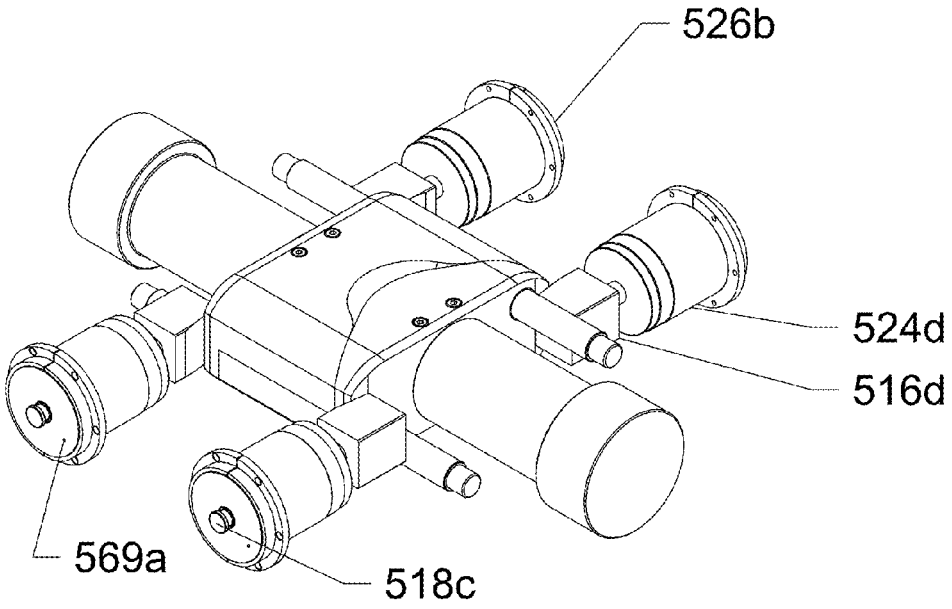
FIG. 20 is an external perspective of the close position with locking dogs advanced into contact with the rear faces of the ram blocks.

FIG. 20 is an external perspective of the close position with locking dogs, such as 516*d*, advanced into contact with the rear faces of the ram blocks. The ram blocks are held in close position in this perspective view.

Figure 21:
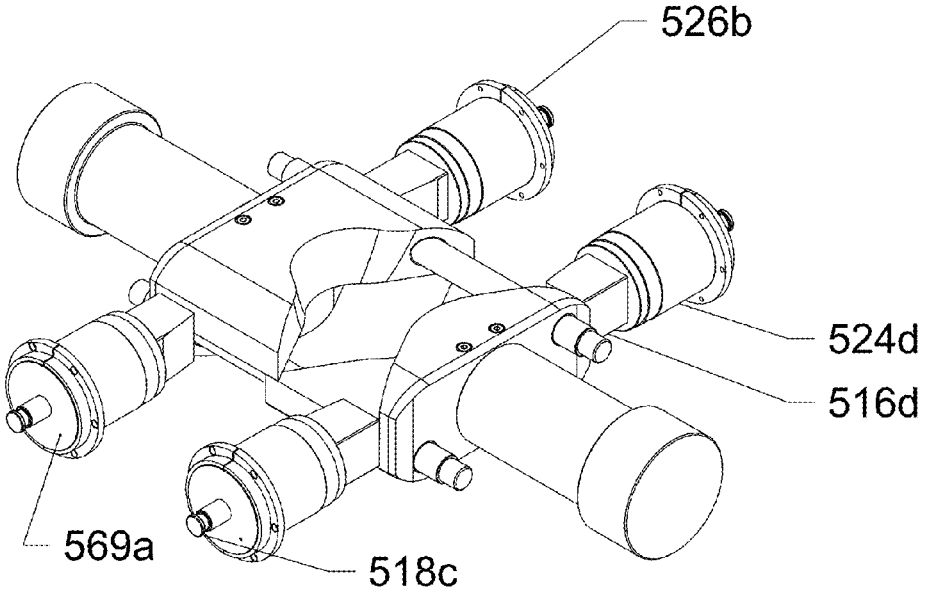
FIG. 21 is an external perspective of the open position, with locking dogs in normal retracted position at the side of the ram block.

FIG. 21 is an external perspective of the open position, with locking dogs in normal retracted position at the side of the ram block.

Figure 22:
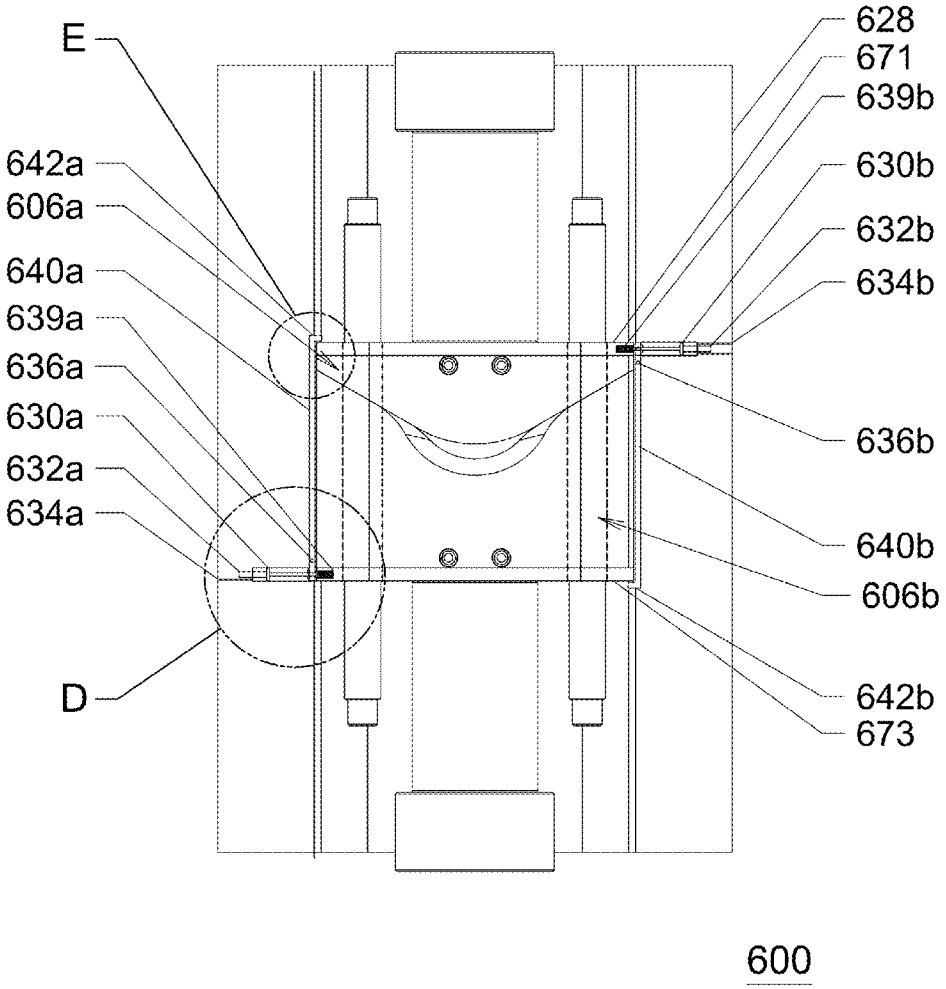
FIG. 22 depicts a further embodiment by an overhead cross section of two opposing ram blocks

FIG. 22 depicts Embodiment 600 and is an overhead cross section of two opposing ram blocks, upper ram block 606*b* and lower ram block 606*a*, in close position, and depicted with a means of locking the ram blocks in the close position. The means of locking the ram blocks in position in FIG. 22 is shown with the ram blocks and rails of Embodiment 100, although Embodiments 200 and 300 are equally compatible with 600. BOP body 628 is shown housing the ram blocks and locking components.

Embodiment 600's means of locking the ram blocks in close position is a latch system. Left latch 640*a* and right latch 640*b* are shown in a locked position or close position. Left latch 640*a* has traveled along the side of lower ram block 606*a*, abruptly moved toward lower ram block 606*a* upon reaching its end and the trailing edge of left catch 642*a* having passed lower ram block rear face 671, and left latch catch 642*a* has closed and held on lower ram block rear face 671. Left latch 640*a* is attached to upper ram block 606*b* at left hinge 636*a*. Thus, in the close position, left latch 640*a*, which is attached to upper ram block 606*b*, holds lower ram block 606*a* with left catch 642*a* and prevents separation of the ram blocks. Duplicate components have operated on the right side. There, right latch 640*b* has traveled along the side of upper ram block 606*b*, abruptly moved toward upper ram block 606*b* upon reaching its end and the trailing edge of right catch 642*b* having passed upper ram block rear face 673, and right latch catch 642*b* has closed and held on upper ram block rear face 673. Right latch 640*b* is attached to lower ram block 606*a* at right hinge 636*b*. On the right side, right latch 640*b*, which is attached to lower ram block 606*a*, holds upper ram block 606*b* with right catch 642*b* and prevents separation of the ram blocks.

In an open position, both latches are held to the side of the ram blocks with springs. Left close-assist spring 639*a* is in compression and exerts force against left latch 640*a* at the end of 640*a* proximal to left hinge 636*a*, urging the distal end of 640*a* with left latch catch 642*a* toward the side of the ram block. Likewise on the right side in the open position, right close-assist spring 639*b* is in compression and exerts force against right latch 640*b* at the end of 640*b* proximal to right hinge 636*b*, urging the distal end of 640*b* with right latch catch 642*b* toward the side of the ram block.

In order to unlatch the latches and free the ram blocks from the close position, actuating hydraulic fluid pressure is supplied via left hydraulic port 634*a* and right hydraulic port 634*b*. With fluid pressure through left hydraulic port 634*a*, left hydraulic cylinder 630*a* advances the distal end of left piston 632*a* to force the end portion of left latch 640*a* toward left close-assist spring 639*a*, further compressing the spring, and concurrently moving the distal end of 640*a* with left latch catch 642*a* outward from the side of the ram block and off of lower ram block rear face 671. This frees lower ram block 606*a* and upper ram block 606*b* to travel to the open position. The same unlatching process occurs on the right side when actuating hydraulic fluid pressure is supplied via right hydraulic port 634*b*. 630*b* advances to the distal end of right piston 632*b* to force the end portion of right latch 640*b* toward right close-assist spring 639*b*, further compressing the spring, and concurrently moving the distal end of 640*b* with right latch catch 642*b* outward from the side of the ram block and off of upper ram block rear face 673. This frees upper ram block 606*b* to return to the open position, and by freeing 606*b* concurrently frees the hinge-attached 606*a*.

Figure 23:
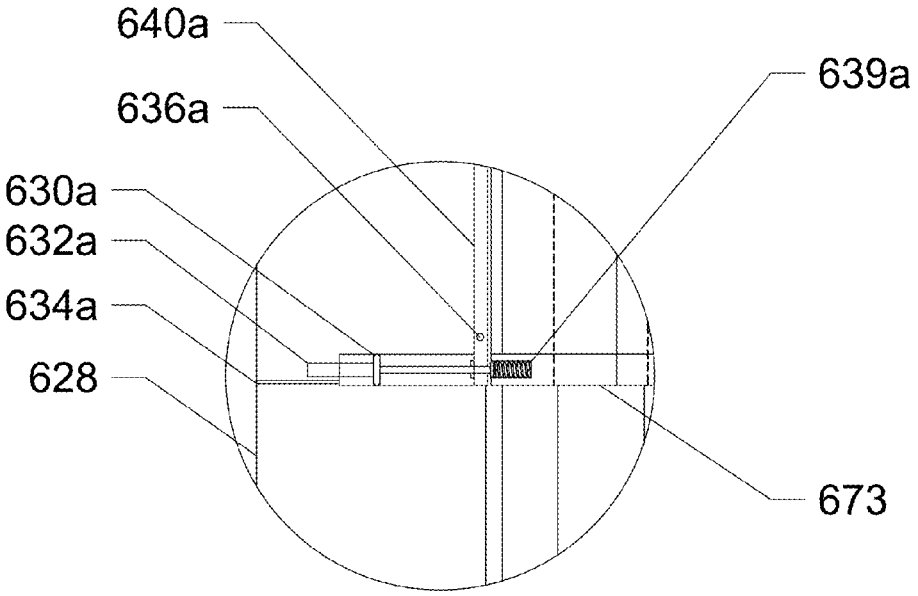
FIG. 23 shows an enlarged view of close-assist spring and the hydraulic components needed to unlatch left latch.
Figure 24:
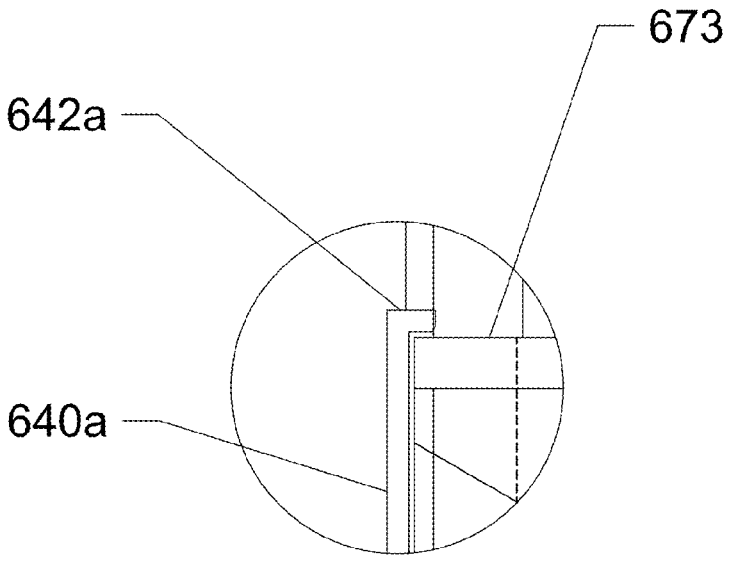
FIG. 24 provides an enlarged view of the end distal from close-assist spring.

Exploded views, Detail D and Detail E are highlighted with dashed lines, with D shown on FIG. 23 and E shown on FIG. 24.

FIG. 23 shows Detail D, an enlarged view of close-assist spring 639*a* and the hydraulic components needed to unlatch left latch 640*a* in order to free the ram blocks. Left hinge 636*a* is attached to upper ram block 606*b*, although the full hinge attachment is not shown in the drawing.

FIG. 24 shows Detail E, an enlarged view of the end distal from close-assist spring 639*a*. Left latch catch 642*a* is holding static against upper ram block rear face 673 and maintaining the close position, preventing separation of the ram blocks.

Figure 25:
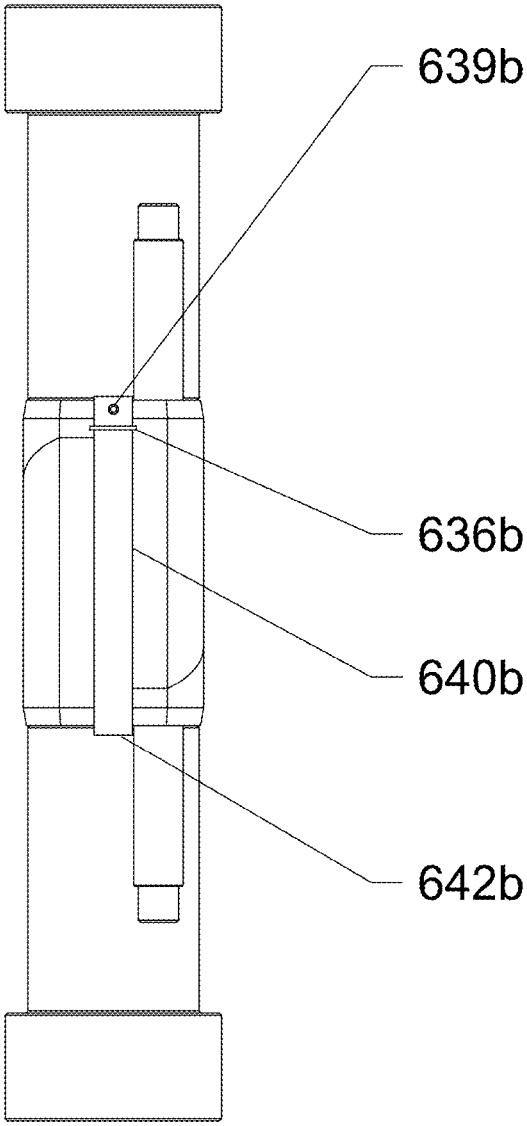
FIG. 25 presents is an external side view of an alternative embodiment without a BOP body.

FIG. 25 is an external side view of Embodiment 600 without BOP body 628. Open-assist spring 639*b* is under right latch 640*b* and distal from right latch catch 642*b*. FIG. 25 shows the close position with 640*b* and right latch catch 642*b* holding the ram blocks static, preventing separation of the ram blocks.

Figure 26:
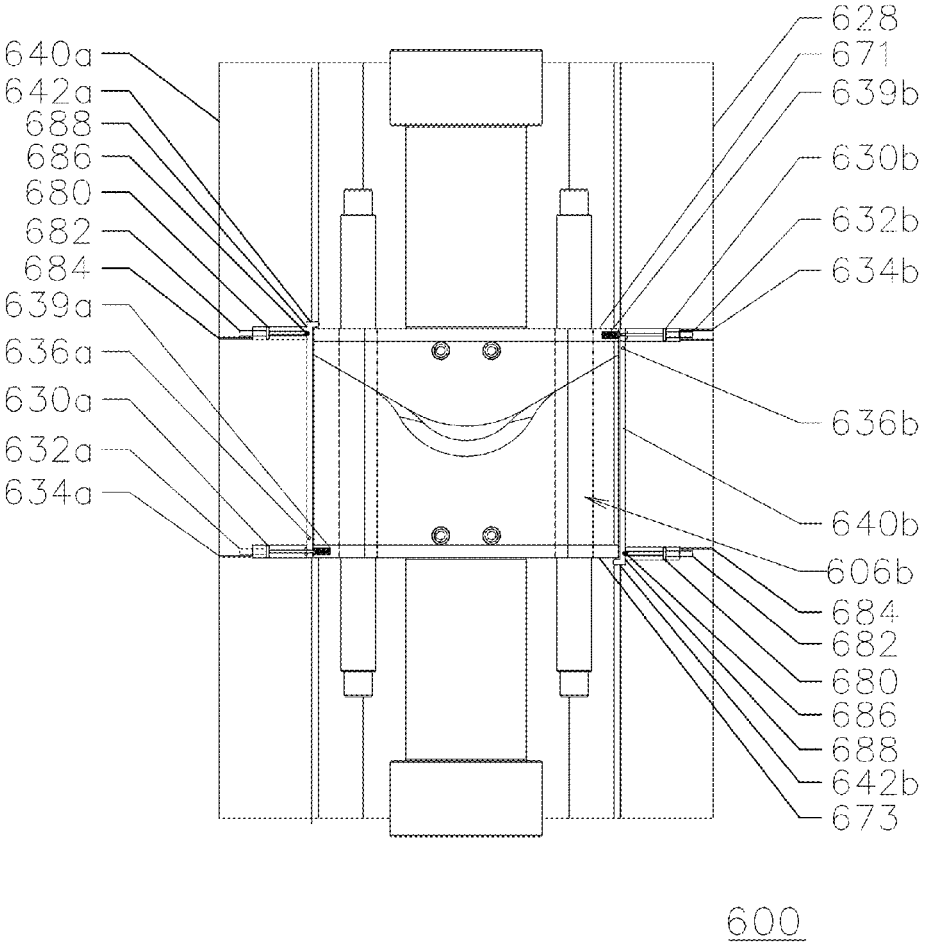
FIG. 26 illustrates an optional hydraulic cylinder that ensures unlatching of the latches in an area of the latches proximal to right latch catch and left latch catch.

Continuing with Embodiment 600, FIG. 26 shows an optional hydraulic cylinder 682 to ensure unlatching of the latches in an area of the latches proximal to right latch catch 642*b* and left latch catch 642*a*. A hydraulic cylinder 682 (or spring biasing mechanism, not shown) actuates a stab hook 686 into stab receiver orifice 688 on left latch 640*a* and right latch 640*b* so that the stab hook catches on, gains mechanical hold, and subsequently retracts left latch 640*a* (and right latch 640*b* through an identical right-side mechanism) as the stab-and-pull/catch tool retracts. Latch-open-assist hydraulic port 684 provides fluid pressure to the hydraulic cylinder 682 and retracts the stab hook 686 and latch with it when reversed or if a spring-assist mechanism (not shown) is provided. An external attachment to the hydraulic cylinder, to enable mechanical force to be applied to the body of the hydraulic cylinder, can be used to apply force to pull the latch open in the event hydraulic force is insufficient.

The detailed description set forth herein in connection with the appended drawings is intended as a description of exemplary embodiments in which the presently disclosed subject matter may be practiced. The term "exemplary" used throughout this description means "serving as an example, instance, or illustration," and should not necessarily be construed as preferred or advantageous over other embodiments.

This detailed description of illustrative embodiments includes specific details for providing a thorough understanding of the presently disclosed subject matter. However, it will be apparent to those skilled in the art that the presently disclosed subject matter may be practiced without these specific details. In some instances, well-known structures and devices are shown in block diagram form in order to avoid obscuring the concepts of the presently disclosed method and system.

The foregoing description of embodiments is provided to enable any person skilled in the art to make and use the subject matter. Various modifications to these embodiments will be readily apparent to those skilled in the art, and the novel principles and subject matter disclosed herein may be applied to other embodiments without the use of the innovative faculty. The claimed subject matter set forth in the claims is not intended to be limited to the embodiments shown herein, but is to be accorded the widest scope consistent with the principles and novel features disclosed herein. It is contemplated that additional embodiments are within the spirit and true scope of the disclosed subject matter.

What is claimed is:

1. A lockable ram block assembly for use in a wellbore blowout preventer, comprising:

a pair of shear ram blocks positioned, for moving in opposition from an open position to closed position and from a closed position back to said open position, and enabling provides a shearing, breaking or parting force to material positioned between said shear ram blocks guide rails for guiding the movement of said movement in opposition of said shear ram blocks;

passageways within said shear ram blocks and throughout said lockable ram block assembly to accept said guide rails, said shear ram blocks having a hydraulically actuated locking mechanism, with locking dogs exposed to wellbore pressure moving from a lateral starting position to an area behind said shear ram blocks and creating a mechanical lock to obstruct possible rearward movement of said shear ram blocks for maintaining said shear ram blocks in the closed position until hydraulically or mechanically returned to the starting position and no longer obstructing movement of said shear ram blocks, for allowing said shear ram blocks to return to the open position.

2. The assembly of claim 1, where said shear ram blocks further comprise grooves in an upper and a lower portion of said shear ram blocks to accept sealing material.

3. The assembly of claim 1, wherein a ram block may be removed from one side of the wellbore blowout preventer, rotated 180 degrees about the longitudinal center line, and inserted into the other side in opposition to and correctly mating with the opposing shear ram block, and with said guide rails and said passageways arranged to preclude improper insertion.

4. The assembly of claim 1, wherein said shear ram blocks further comprise a locking mechanism in the form of latches, wherein said latches travel along the side of said shear ram blocks so that upon reaching a rear end of the opposing shear ram blocks moving to said closed position, said latches close on the edge of said rear end of said opposing shear ram blocks and mechanically hold said shear ram blocks in said closed position until an unlatching force is applied.

5. The assembly of claim 4, with hydraulically actuated hooks for securing and pulling said latches from contact with said rear end of said opposing shear ram blocks for returning said shear ram blocks to said open position.

6. Method, comprising:

Using guide rails and passageways for guide rails within a pair of shear ram blocks and a ram block assembly for aligning said shear ram blocks on a parallel trajectory for concentrating horizontal opposing forces in a small, designed area so as to limit deviation, divergence, cocking, heeling or veering and thereby enable efficient and fast shearing of material positioned between said shear ram blocks in the wellbore; and using passageways within the said shear ram blocks and throughout said lockable ram block assembly to accept said guide rails, said shear ram blocks having a hydraulically actuated locking mechanism, with locking dogs exposed to wellbore pressure moving from a lateral starting position to an area behind said shear ram blocks and creating a mechanical lock to obstruct possible rearward movement of said shear ram blocks for maintaining said shear ram blocks in the closed position until hydraulically or mechanically returned to the starting position and no longer obstructing movement of said shear ram blocks, for allowing said shear ram blocks to return to the open position.

* * * * *